US012480657B1

(12) United States Patent
Ataman et al.

(10) Patent No.: US 12,480,657 B1
(45) Date of Patent: Nov. 25, 2025

(54) GAS TURBINE ENGINE AND FUEL NOZZLE THEREFOR

(71) Applicants: General Electric Company, Evendale, OH (US); GE Aerospace Poland Sp. z o.o., Warsaw (PL); GE Marmara Technology Center Muhendislik Hizmetleri Ltd, Gebze (TR)

(72) Inventors: Volkan Ataman, Istanbul (TR); Michael T. Bucaro, Arvada, CO (US); Łukasz Filip Tomaszewski, Legionowo (PL); Andrzej Kazimierz Kąkolewski, Warsaw (PL); Bartłomiej Tomaszewski, Warsaw (PL); Fatih Yasar, Tuzla (TR); Mariusz Konopka, Warsaw (PL)

(73) Assignees: General Electric Company, Evendale, OH (US); GE Aerospace Poland Sp. z o.o., Warsaw (PL); GE Marmara Technology Center Muhendislik Hizmetleri Ltd., Gebze (TR)

( * ) Notice: Subject to any disclaimer, the term of this patent is extended or adjusted under 35 U.S.C. 154(b) by 0 days.

(21) Appl. No.: 19/193,186

(22) Filed: Apr. 29, 2025

(51) Int. Cl.
*F23R 3/28* (2006.01)

(52) U.S. Cl.
CPC ..... *F23R 3/28* (2013.01)

(58) Field of Classification Search
CPC .. F23R 3/002; F23R 3/60; F23R 3/283; F23R 3/28; F02C 7/222; F02C 7/22
See application file for complete search history.

(56) References Cited

U.S. PATENT DOCUMENTS

| | | | | |
|---|---|---|---|---|
| 2,616,258 A | | 11/1952 | Mock | |
| 2,893,365 A | | 7/1959 | Haefner | |
| 3,516,252 A | * | 6/1970 | Beane | F23R 3/283 60/739 |
| 4,466,240 A | | 8/1984 | Miller | |
| 4,938,019 A | | 7/1990 | Angell | |
| 5,253,810 A | | 10/1993 | Maltby | |
| 5,279,112 A | * | 1/1994 | Halila | F02M 37/0017 285/13 |
| 5,328,102 A | | 7/1994 | Babitzka | |
| 5,771,696 A | * | 6/1998 | Hansel | F23D 23/00 60/746 |

(Continued)

FOREIGN PATENT DOCUMENTS

| | | | | |
|---|---|---|---|---|
| CN | 217526000 U | | 10/2022 | |
| CN | 115509329 A | * | 12/2022 | G06F 1/20 |

(Continued)

*Primary Examiner* — Craig Kim
(74) *Attorney, Agent, or Firm* — Carter, DeLuca & Farrell LLP

(57) ABSTRACT

A gas turbine engine comprising a combustion section having a case and a combustor, the combustor disposed at least partially in the case. The combustor comprises a dome assembly, a liner at least partially defining a combustion chamber, a plurality of mounting arms extending forward from the dome assembly, and a fuel nozzle assembly coupled with the dome assembly and including a mounting base. The mounting base couples with the case and engages with a first mounting arm of the plurality of mounting arms and a second mounting arm of the plurality of mounting arms.

20 Claims, 22 Drawing Sheets

(56) References Cited

U.S. PATENT DOCUMENTS

| | | | | |
|---|---|---|---|---|
| 6,250,062 | B1 * | 6/2001 | Lawen, Jr. | F23R 3/283 29/455.1 |
| 6,354,085 | B1 * | 3/2002 | Howell | F23R 3/283 60/740 |
| 7,356,994 | B2 * | 4/2008 | Bleeker | F23R 3/60 60/740 |
| 8,516,830 | B2 * | 8/2013 | Duval | F23R 3/283 60/740 |
| 8,572,987 | B2 * | 11/2013 | Carlisle | F23R 3/283 60/796 |
| 9,714,767 | B2 | 7/2017 | Stewart | |
| 10,267,523 | B2 * | 4/2019 | Metternich | F23R 3/26 |
| 10,641,223 | B2 | 5/2020 | Noguchi | |
| 10,711,920 | B2 | 7/2020 | Dhanasekaran | |
| 11,255,370 | B2 | 2/2022 | Pinney | |
| 11,441,592 | B2 | 9/2022 | Kassel | |
| 11,585,241 | B2 | 2/2023 | Danis | |
| 12,018,567 | B2 | 6/2024 | Savard | |
| 12,055,058 | B2 * | 8/2024 | Fryer | F01D 21/003 |
| 12,354,849 | B2 * | 7/2025 | Park | H01J 37/32642 |
| 2007/0137218 | A1 * | 6/2007 | Prociw | F23R 3/283 60/740 |
| 2010/0058765 | A1 * | 3/2010 | Duval | F23R 3/283 60/740 |
| 2011/0088409 | A1 * | 4/2011 | Carlisle | F23R 3/283 29/700 |
| 2014/0245740 | A1 | 9/2014 | Wiebe | |
| 2015/0000283 | A1 | 1/2015 | Ramier | |
| 2015/0354517 | A1 * | 12/2015 | Mansour | F23D 11/103 239/397.5 |
| 2016/0033130 | A1 * | 2/2016 | Low | F02C 3/00 239/589 |
| 2017/0176010 | A1 * | 6/2017 | Ryon | F02C 7/222 |
| 2019/0120490 | A1 * | 4/2019 | Greenfield | B05B 15/62 |
| 2022/0195940 | A1 * | 6/2022 | Ryon | F02C 7/264 |
| 2024/0271791 | A1 * | 8/2024 | Ryon | F23R 3/283 |
| 2025/0093031 | A1 * | 3/2025 | Ataman | F23R 3/283 |
| 2025/0164103 | A1 * | 5/2025 | Ryon | F23C 5/06 |
| 2025/0216081 | A1 * | 7/2025 | DiCintio | F02C 7/12 |

FOREIGN PATENT DOCUMENTS

| | | | | |
|---|---|---|---|---|
| EP | 3428537 | A1 | 1/2019 | |
| WO | 2015039832 | A1 | 3/2015 | |
| WO | 2017018992 | A1 | 2/2017 | |
| WO | WO-2022112726 | A1 * | 6/2022 | F23R 3/007 |

* cited by examiner

GAS TURBINE ENGINE AND FUEL NOZZLE THEREFOR

TECHNICAL FIELD

The present subject matter relates generally to a gas turbine engine having a fuel nozzle assembly.

BACKGROUND

Turbine engines are driven by a flow of combustion gases passing through the engine to rotate a multitude of turbine blades, which, in turn, rotate a compressor to provide compressed air to the combustor for combustion. A combustor can be provided within the turbine engine and is fluidly coupled with a turbine into which the combusted gases flow.

Historically, hydrocarbon fuels are used in the combustor of a turbine engine. Generally, air and fuel are fed to a combustion chamber, the air and fuel are mixed, and then the fuel is burned in the presence of the air to produce hot gas. The hot gas is then fed to a turbine where it cools and expands to produce power. By-products of the fuel combustion typically include environmentally unwanted byproducts, such as nitrogen oxide and nitrogen dioxide (collectively called $NO_x$), carbon monoxide (CO), unburned hydrocarbons (UHC) (e.g., methane and volatile organic compounds that contribute to the formation of atmospheric ozone), and other oxides, including oxides of sulfur (e.g., $SO_2$ and $SO_3$).

To reduce the environmentally unwanted byproducts, other fuels, such as hydrogen, are being explored. Hydrogen or hydrogen mixed with another element has a higher flame temperature than traditional hydrocarbon fuels. That is, hydrogen or a hydrogen mixed fuel typically has a wider flammable range and a faster burning velocity than traditional hydrocarbon-based fuels.

DETAILED DESCRIPTION

Figure 1:
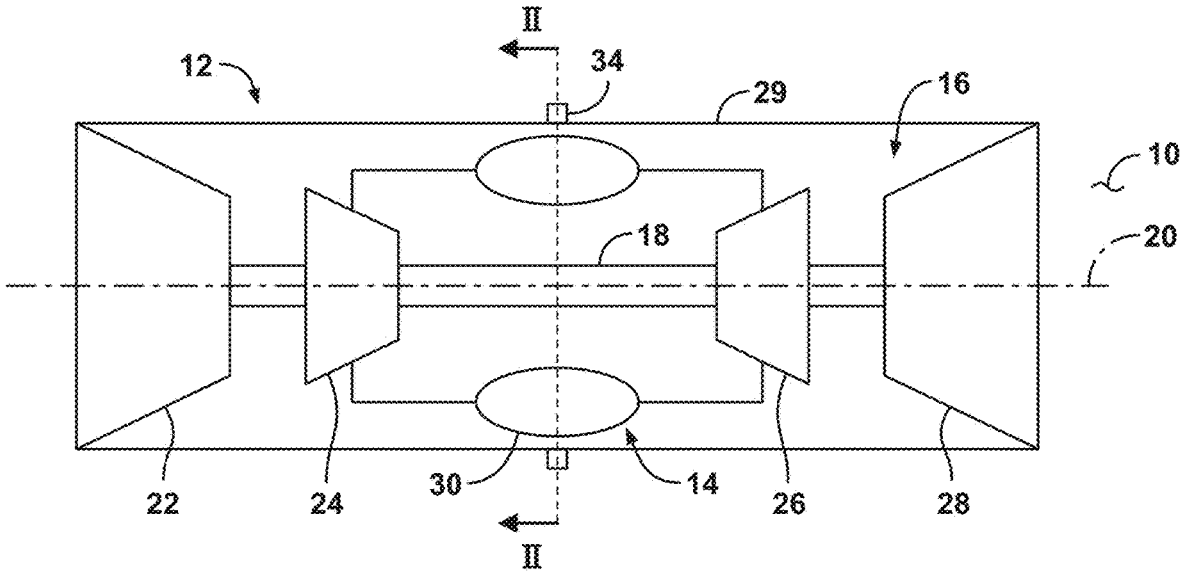
FIG. 1 is a schematic cross-sectional view of a turbine engine having a compression section, a combustion section, and a turbine section in accordance with various aspects described herein.

Aspects of the disclosure described herein are directed to a combustor. For purposes of illustration, the present disclosure will be described with respect to a turbine engine. It will be understood, however, that aspects of the disclosure described herein are not so limited and that a combustor as described herein can be implemented in engines, including but not limited to turbojet, turboprop, turboshaft, and turbofan engines. Aspects of the disclosure discussed herein may have general applicability within non-aircraft engines having a combustor, such as other mobile applications and non-mobile industrial, commercial, and residential applications.

The combustor includes a dome assembly coupled with a combustor liner to at least partially define a combustion chamber and a fuel nozzle assembly or plurality of fuel nozzle assemblies can be coupled with the dome assembly to at least partially form a combustion section. The combustor can then be received within a case where the fuel nozzle is mounted and forms a fluid connection through the case. The fuel nozzle assembly includes a mounting base that abuts an inner surface of the case and a shaft assembly that engages the mounting base to secure the fuel nozzle assembly to the case.

During assembly, receiving the combustor within the case includes aligning the fuel nozzle assembly with a corresponding aperture formed through the case to form the fluid connection therethrough. Further, securing the fuel nozzle assembly to the case can include applying torque or providing rotational forces to one portion of the fuel nozzle assembly (e.g., the shaft assembly) to connect or threadedly engage a second portion (e.g., the mounting base). In at least these aspects of assembly, portions of the fuel nozzle assembly can misalign, shift, or rotate with respect to the inner surface of the case. This can cause damage to the fuel nozzle assembly, accelerate wear and degradation of the casing or combustor surfaces, or otherwise complicate assembly of the combustor and the case.

With assemblies of combustors and cases described herein, a plurality of mounting arms can extend forward from the dome assembly and engage the mounting base to restrict movement in the mounting base relative to the combustor. As such, the mounting base can be held in place to align with the aperture and ease assembly. The mounting arms can further restrict relative movement of the mounting base within the combustor during assembly to reduce damage and wear to the fuel nozzle assembly, the case, or a combination thereof (e.g., chafing of mounting base surfaces about the casing aperture).

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine exhaust.

As used herein, the term "upstream" refers to a direction that is opposite the fluid flow direction, and the term "downstream" refers to a direction that is in the same direction as the fluid flow. The term "fore" or "forward" means in front of something and "aft" or "rearward" means behind something. For example, when used in terms of fluid flow, fore/forward can mean upstream and aft/rearward can mean downstream.

The term "fluid" may be a gas or a liquid. The term "fluid communication" means that a fluid is capable of making the connection between the areas specified.

The term "nozzle" has been used in various ways in the context of gas turbine engines. In the instant application, "nozzle" refers to a component having a portion for fluid coupling to a fuel supply and having at least one portion for fluidly coupling with a combustion chamber. A distal end of a fuel nozzle assembly or a nozzle tube can have nozzle tip, but the nozzle tip is not referred to herein as a nozzle itself.

Additionally, as used herein, the terms "radial" or "radially" refer to a direction away from a common center. For example, in the overall context of a turbine engine, radial refers to a direction along a ray extending between a center longitudinal axis of the engine and an outer engine circumference. In the context of a coupling of a fuel nozzle, radial can refer to a direction along a ray extending between a centerline of the coupling or a shaft thereof and an outer circumference of the coupling.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate structural elements between a collection of elements and relative movement between elements unless otherwise indicated. As such, connection references do not necessarily infer that two elements are directly connected and in fixed relation to one another. The exemplary drawings are for purposes of illustration only the dimensions, positions, order, and relative sizes reflected in the drawings attached hereto can vary.

The singular forms "a", "an", and "the" include plural references unless the context clearly dictates otherwise.

Furthermore, as used herein, the term "set" or a "set" of elements can be any number of elements, including only one.

Uses of "and" and "or" are to be construed broadly. For example and without limitation, uses of "and" do not necessarily require all elements or features listed, and uses of "or" are inclusive unless such a construction would be illogical.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and systems. In at least some instances, the approximating language may correspond to the precision of an instrument for measuring the value, or the precision of the methods or machines for constructing or manufacturing the components and systems. For example, the approximating language may refer to being within a 1, 2, 4, 5, 10, 15, or 20 percent margin in either individual values, range(s) of values and endpoints defining range(s) of values. Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

"Proximate" as used herein is not limiting, rather a descriptor for locating parts described herein. Further, the term "proximate" means nearer or closer to the part recited than the following part. For example, a first hole proximate a wall, the first hole located upstream from a second hole means that the first hole is closer to the wall than the first hole is to the second hole.

FIG. 1 is a schematic view of a turbine engine 10. As a non-limiting example, the turbine engine 10 can be used within an aircraft. The turbine engine 10 can include, at least, a compressor section 12, a combustion section 14, and a turbine section 16, such as in a serial flow arrangement. A drive shaft 18 rotationally couples the compressor section 12 and turbine section 16, such that rotation of one affects the rotation of the other, and defines a rotational axis 20 for the turbine engine 10.

The compressor section 12 can include a low-pressure (LP) compressor 22, and a high-pressure (HP) compressor 24 serially fluidly coupled with one another. The turbine section 16 can include an HP turbine 26, and an LP turbine 28 serially fluidly coupled with one another. The drive shaft 18 can operatively couple the LP compressor 22, the HP compressor 24, the HP turbine 26 and the LP turbine 28 together. Alternatively, the drive shaft 18 can include an LP drive shaft (not illustrated) and an HP drive shaft (not illustrated). The LP drive shaft can couple the LP compressor 22 to the LP turbine 28, and the HP drive shaft can couple the HP compressor 24 to the HP turbine 26. An LP spool can be defined as the combination of the LP compressor 22, the LP turbine 28, and the LP drive shaft such that the rotation of the LP turbine 28 can apply a driving force to the LP drive shaft, which in turn can rotate the LP compressor 22. An HP spool can be defined as the combination of the HP compressor 24, the HP turbine 26, and the HP drive shaft such that the rotation of the HP turbine 26 can apply a driving force to the HP drive shaft which in turn can rotate the HP compressor 24.

The compressor section 12 can include one or a plurality of axially spaced stages. Each stage includes a set of circumferentially-spaced rotating blades and a set of circumferentially-spaced stationary vanes. The compressor blades for a stage of the compressor section 12 can be mounted to a disk, which is mounted to the drive shaft 18. Each set of blades for a given stage can have its own disk. The vanes of the compressor section 12 can be mounted to a case which can extend circumferentially about and enshroud one or more sections of the turbine engine 10. It will be appreciated that the representation of the compressor section 12 is merely schematic and that there can be any number of blades, vanes and stages. Further, it is contemplated that there can be any number of other components within the compressor section 12.

Similar to the compressor section 12, the turbine section 16 can include one or a plurality of axially spaced stages, with each stage having a set of circumferentially-spaced, rotating blades and a set of circumferentially-spaced, stationary vanes. The turbine blades for a stage of the turbine section 16 can be mounted to a disk which is mounted to the drive shaft 18. Each set of blades for a given stage can have its own disk. The vanes of the turbine section 16 can be mounted to the case in a circumferential manner. It is noted that there can be any number of blades, vanes and turbine stages as the illustrated turbine section 16 is merely a schematic representation. Further, it is contemplated that there can be any number of other components within the turbine section 16.

The combustion section 14 can be provided serially between the compressor section 12 and the turbine section 16. The combustion section 14 can be fluidly coupled with at least a portion of the compressor section 12 and the turbine section 16 such that the combustion section 14 at least partially fluidly couples the compressor section 12 to the turbine section 16. As a non-limiting example, the combustion section 14 can be fluidly coupled with the HP compressor 24 at an upstream end of the combustion section 14 and to the HP turbine 26 at a downstream end of the combustion section 14.

During operation of the turbine engine 10, ambient or atmospheric air is drawn into the compressor section 12 via a fan (not illustrated) upstream of the compressor section 12, where the air is compressed defining a pressurized air. The pressurized air can then flow into the combustion section 14 where the pressurized air is mixed with fuel and ignited, thereby generating combustion gases. Some work is extracted from these combustion gases by the HP turbine 26, which drives the HP compressor 24. The combustion gases are discharged into the LP turbine 28, which extracts additional work to drive the LP compressor 22, and the exhaust gas is ultimately discharged from the turbine engine 10 via an exhaust section (not illustrated) downstream of the turbine section 16. The driving of the LP turbine 28 drives the LP spool to rotate the fan (not illustrated) and the LP compressor 22. The pressurized airflow and the combustion gases can together define a working airflow that flows through the fan, compressor section 12, combustion section 14, and turbine section 16 of the turbine engine 10. In a non-limiting example, a combustor 30 can have a combination arrangement located with a shroud or case 29 of the turbine engine 10. The shroud or case 29 can enshroud or cover at least a portion of the combustion section 14. The combustor 30 can include or is connected to a fuel supply 34 (e.g., an external fuel manifold).

Figure 2:
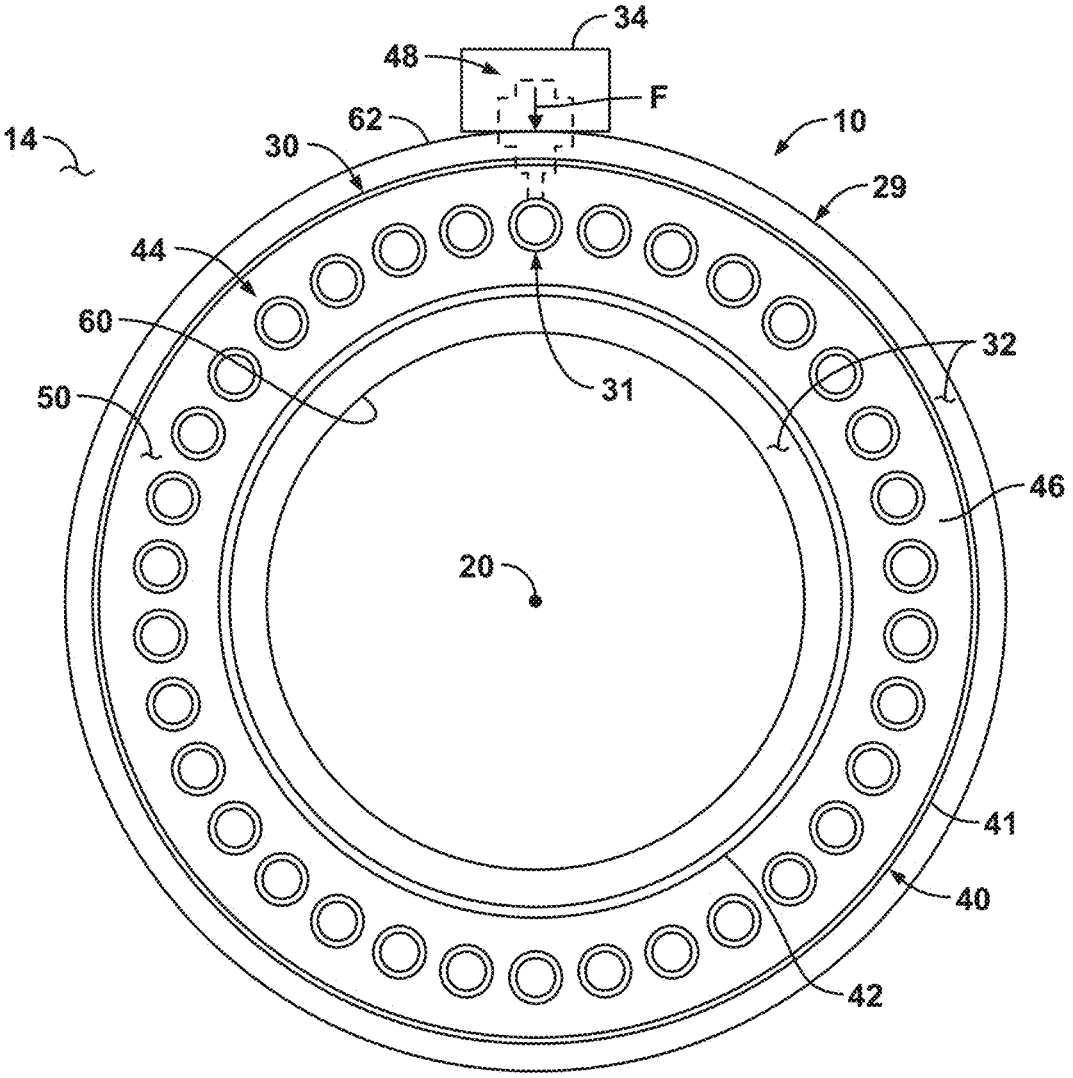
FIG. 2 is a schematic view of the combustion section of FIG. 1 along line II-II in accordance with various aspects described herein.

FIG. 2 depicts a cross-sectional view of the combustion section 14 along line II-II of FIG. 1. The combustion section 14 can include the combustor 30 with an annular arrangement of combustor portions 31 (e.g., combustor cups, fuel cups, etc.) disposed around the centerline or rotational axis 20 of the turbine engine 10. The combustor 30 can have a can, can-annular, or annular arrangement depending on the type of engine in which the combustor 30 is located.

The combustor 30 can be at least partially defined by a combustor liner 40. In some examples, the combustor liner 40 can include an outer liner 41 and an inner liner 42 concentric with respect to each other and arranged in an annular fashion about the engine centerline or rotational axis 20. In some examples, the combustor liner 40 can have an annular structure about the combustor 30. In some examples, the combustor liner 40 can include multiple segments or portions collectively forming the combustor liner 40. In some examples, the combustor liner 40 can include the outer liner 41 radially spaced from the inner liner 42. In some examples, the combustor liner 40 can include a single liner.

A dome assembly 44 together with the combustor liner 40 can at least partially define a combustion chamber 50 arranged annularly about the rotational axis 20. For example, a dome wall 46 of the dome assembly 44 can be substantially perpendicular to the rotational axis 20 and can cooperate with the outer liner 41, the inner liner 42, or both, to at least partially define the combustion chamber 50. A compressed air passage 32 can be defined at least in part by both the combustor liner 40 and the case 29.

The fuel supply 34 can supply fuel F. The fuel supply 34 can be connected to an outer surface 62 of the case 29, which can be an opposite surface from an inner surface 60. A fuel nozzle assembly 48 fluidly couples the fuel supply 34 with the combustor portions 31 and the combustion chamber 50. The fuel F can include any suitable fuel, including hydrocarbon fuel or hydrogen fuel in non-limiting examples. For example, the fuel nozzle assembly 48 can be a hydrogen fuel nozzle assembly. The combustor portions 31 can be separately connected to the dome wall 46. For example and without limitation, the combustor portions 31 can be arranged in a circumferentially spaced configuration. The combustor portions 31 can be disposed at a radial distance from the rotational axis 20 that is greater than a radial distance of the inner liner 42 and less than a radial distance of the outer liner 41.

Figure 3:
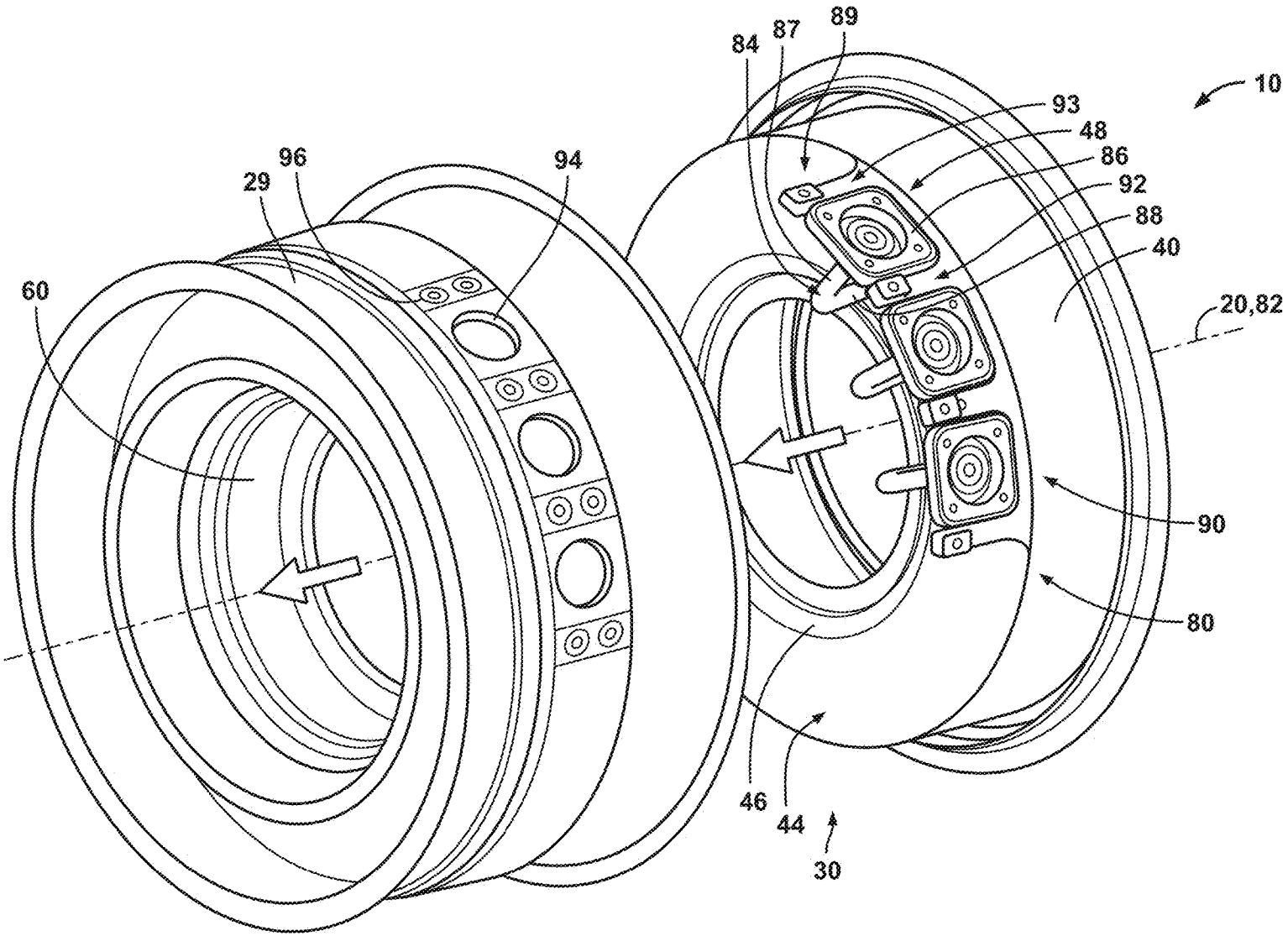
FIG. 3 is a partially exploded perspective view illustrating portions of a combustion section in accordance with various aspects described herein.

FIG. 3 generally illustrates the case 29 and the combustor 30. The combustor 30 includes the dome assembly 44, the combustor liner 40, the fuel nozzle assembly 48, and a plurality of mounting arms 80. The dome assembly 44 and the combustor liner 40 are coupled with the fuel nozzle assembly 48 according to some aspects of the present disclosure. By way of non-limiting example, the engine centerline or rotational axis 20 is illustrated as colinear with a combustor centerline 82 of the combustor 30. In some examples, the dome wall 46 of the dome assembly 44 can be substantially annular and substantially perpendicular to at least some portions of the combustor liner 40 but can include other configurations. As shown, a shape of the combustor liner 40, together with the dome assembly 44, can correspond to a shape of the inner surface 60 of the case 29.

The fuel nozzle assembly 48 includes a nozzle tube 84 and a mounting base 86. A proximal end 87 of the nozzle tube 84 can be connected to the mounting base 86. The nozzle tube 84 can be fluidly coupled with the fuel supply 34 (FIG. 2), such that the nozzle tube 84 can provide fuel F received by the fuel nozzle assembly 48 to the combustion chamber 50 (FIG. 2). The nozzle tube 84 extends between the mounting base 86 and the dome assembly 44. In some configurations, the nozzle tube 84 can have a generally L-shaped configuration where the nozzle tube 84 extends radially inward from the mounting base 86 toward the combustor centerline 82 and bends to extend rearward, toward the dome assembly 44. A distal end 88 of the nozzle tube 84 can couple to the dome wall 46 of the dome assembly 44. The nozzle tube 84 can be rigidly fixed (e.g., bolted, brazed, welded, riveted, fastened, etc.) to the mounting base 86, the dome assembly 44, or both.

The mounting base 86 can be coupled with the nozzle tube 84 and can be positioned at least partially between a first mounting arm 92 and a second mounting arm 93 of the plurality of mounting arms 80. The plurality of mounting arms 80 can be formed with or mechanically coupled with the combustor liner 40, the dome assembly 44, or both. For example, the plurality of mounting arms 80 can extend forward from the dome assembly 44 and engage with the mounting base 86 to restrict movement of the mounting base 86, such as during assembly of the combustor 30 with the case 29. The representation of the plurality of mounting arms 80 is merely schematic and there can be other numbers of mounting arms. In some configurations, as illustrated, the fuel nozzle assembly 48 can be one of a plurality of fuel nozzle assemblies 89, where the mounting base 86 is one of a plurality of mounting bases 90 of the plurality of fuel nozzle assemblies 89. While the plurality of fuel nozzle assemblies 89 is shown with three fuel nozzle assemblies, other numbers of fuel nozzle assemblies can be utilized. The plurality of mounting bases 90 are circumferentially spaced about the combustor centerline 82. The plurality of mounting bases 90 and the plurality of mounting arms 80 can be arranged in an alternating configuration with each mounting arm disposed at least partially circumferentially between and coupled with each adjacent pair of fuel nozzle assemblies of the plurality of fuel nozzle assemblies 89. For example, each mounting base of the plurality of mounting bases 90 can be coupled with two mounting arms of the plurality of mounting arms 80, and each mounting arm of the plurality of mounting arms 80 can be coupled with two mounting bases of the plurality of mounting bases 90.

While the mounting base 86 is illustrated as having a rounded square cross-section, other cross-sectional shapes are contemplated, including but not limited to, an arcuate shape (e.g., curved, circular, oval), a polygonal or rounded polygonal shape (e.g., a rectangle, hexagon, among others), or a combination thereof.

Prior to aligning the mounting base 86 with a case aperture 94 for assembly, the mounting base 86 can be engaged with one or more of the plurality of mounting arms 80, such as with the first mounting arm 92 and the second mounting arm 93. The engagement between the mounting base 86 and one or more of the plurality of mounting arms 80 can include contact between the mounting base 86 and the plurality of mounting arms 80, or that the mounting base 86 and the plurality of mounting arms 80 are spaced apart such that contact can occur during assembly (e.g., to limit forces applied to other components). In such a configuration, the first and second mounting arms 92, 93 can restrict movement of the mounting base 86 relative to the dome assembly 44 and the combustor liner 40. For example, during assembly of the combustor 30 with the case 29, the combustor 30 is inserted into the case 29, and engagement between the mounting base 86 and the first and second mounting arms 92, 93 can limit movement of the mounting base 86 to limit forces applied to the mounting base 86 and the nozzle tube 84, such as to limit damage to the nozzle tube 84. The forces applied to the mounting base 86 can be a result of the mounting base 86 contacting portions of the case 29, such as due to misalignment during insertion, exceeding an intended insertion depth, or a combination thereof. During assembly, the engagement between the mounting base 86 and the first and second mounting arms 92, 93 can transfer some or all of such forces to the dome assembly 44, the combustor liner 40, or both, instead of to the nozzle tube 84. Prior to assembly, after the completion of assembly, or both, the mounting base 86 can remain engaged with the first and second mounting arms 92, 93 but not in contact with the first and second mounting arms 92, 93. For example, the mounting base 86 and the first and second mounting arms 92, 93 can include a first engaged configuration (e.g., a preassembly and post assembly configuration) in which the mounting base 86 is not in contact with the first and second mounting arms 92, 93, and can include a second engaged configuration (e.g., during assembly) in which the mounting base 86 is in contact with at least one of the first mounting arm 92 or the second mounting arm 93.

In an assembled configuration, the fuel nozzle assembly 48 can extend through the case 29, such as through the case aperture 94, and the mounting base 86 can be adjacent to, in contact with, rigidly fixed to, or a combination thereof, the inner surface 60 of the case 29. The case 29 can further include a plurality of through holes 96 for receiving fasteners that can extend through the case 29 and into the mounting base 86 to secure the mounting base 86 and the fuel nozzle assembly 48 to the case 29. While illustrated having four through holes 96 for the fuel nozzle assembly 48, the number of through holes 96 in the case 29 can, in some examples, be different (e.g., less or more than four). The through holes 96 can be arranged about the case aperture 94. In examples with the plurality of fuel nozzle assemblies 89, the case 29 includes a respective case aperture (e.g., case aperture 94) and a respective plurality of through holes (e.g., through hole 96) for each fuel nozzle assembly of the plurality of fuel nozzle assemblies 89.

Figure 4:
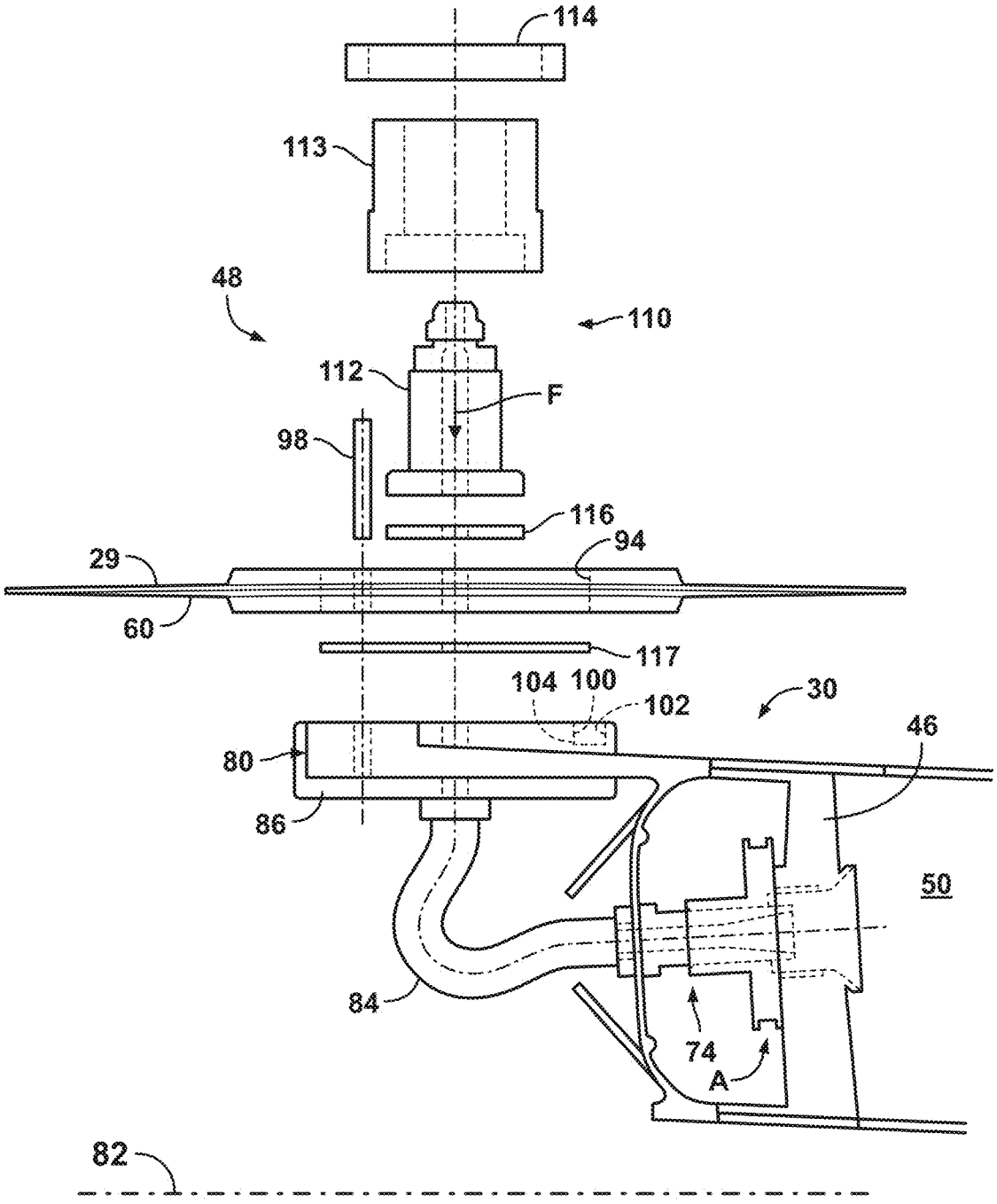
FIG. 4 is a partially exploded schematic view illustrating portions of a fuel nozzle assembly connected to a case and a dome wall in accordance with various aspects described herein.

FIG. 4 shows the fuel nozzle assembly 48 having the plurality of mounting arms 80 and the mounting base 86 aligned with the case aperture 94 for connection with the inner surface 60 of the case 29. As illustrated, an outer diameter of the mounting base 86 can be larger than a diameter of the case aperture 94 such that the mounting base 86 can abut the inner surface 60 of the case 29 and cannot be passed therethrough. The mounting base 86 can include a channel 104 that can be annular and open radially outward, relative to the combustor centerline 82. As a non-limiting example, the channel 104 can be an annular channel. The mounting base 86 can include at least one threaded surface in an inner portion 100, an outer portion 102, or both of the channel 104.

The fuel nozzle assembly 48 further comprises a shaft assembly 110 that can extend through the case 29 and fluidly couple to the fuel supply 34 (FIG. 2). The shaft assembly 110 includes a first shaft 112, a second shaft 113, and a nut 114. In an assembled configuration, the first shaft 112 and the second shaft 113 extend through the case aperture 94 and engage with the mounting base 86. The second shaft 113 can slide at least partially over the first shaft 112 and threadedly engage the mounting base 86 to secure the first shaft 112 to the mounting base 86. The nut 114 can engage the second shaft 113 to secure the fuel nozzle assembly 48 with the case 29. For example, the nut 114 can be threaded on the second shaft 113 until the nut 114 contacts the outer surface 62 of the case 29, which can apply a clamping force to the case 29 to mount the fuel nozzle assembly 48 to the case 29, such as in addition to any mounting provided via one or more fasteners 98. In the assembled configuration, the nut 114 can be disposed opposite the mounting base 86 with a portion of the case 29 therebetween. One or more seals, illustrated as seals 116, 117, can be disposed between the mounting base 86 and the case 29, between the mounting base 86 and the shaft assembly 110, or both.

In some examples, the fuel nozzle assembly 48 can include or be fluidly coupled with a swirler 74 of the combustor 30. The swirler 74 can be provided at or about the dome wall 46 and, in some instances, can extend into or through the dome wall 46. The swirler 74 can swirl incoming air A, such as compressed air from the compressor section 12 (FIG. 1), in proximity of fuel F exiting the nozzle tube 84, which may facilitate a homogeneous mixture of air A and fuel F entering the combustion chamber 50. In some configurations, the swirler 74 can be fixed (e.g., rigidly, permanently) to the dome wall 46. For example, the swirler 74 can be rigidly fixed to the dome wall 46 via welding, brazing, fasteners, or a combination thereof. Additionally or alternatively, the nozzle tube 84 can be rigidly fixed to the swirler 74, which can rigidly fix the nozzle tube 84 to the dome wall 46.

Figure 5:
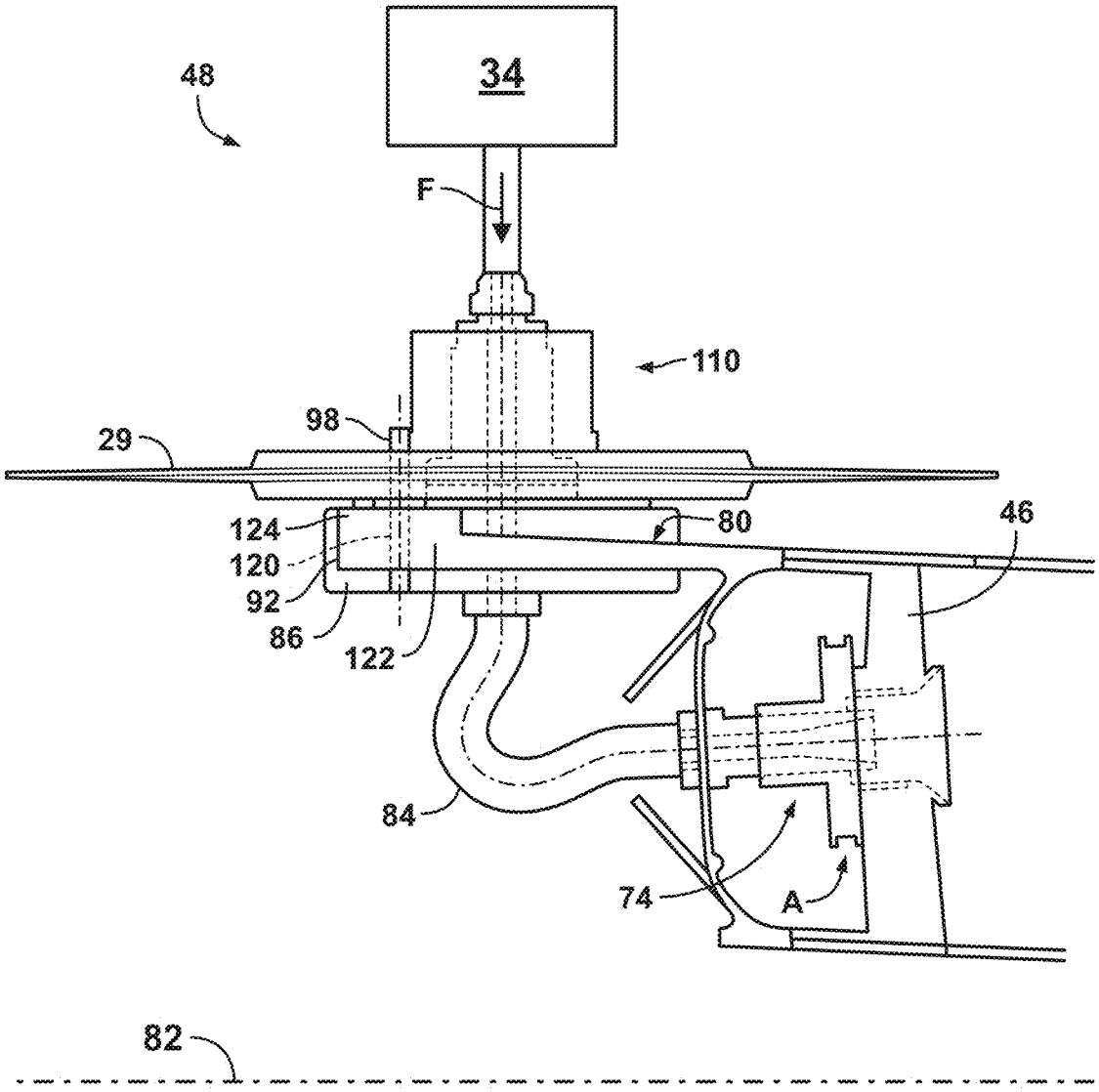
FIG. 5 is a schematic view of the fuel nozzle assembly of FIG. 4 in an assembled configuration according to various aspects described herein.

FIG. 5 illustrates the fuel nozzle assembly 48 assembled and secured to the case 29 and the dome wall 46 via the swirler 74. The shaft assembly 110 can fluidly couple the fuel nozzle assembly 48, the mounting base 86, or both to the fuel supply 34. Connecting the shaft assembly 110 to the mounting base 86 can include providing rotational forces to the shaft assembly 110 (e.g., by screwing components together). With some configurations, the shaft assembly 110 can be held in place to limit or prevent a transfer of the rotational forces to the mounting base 86 or the nozzle tube 84, such as to prevent damage to or misalignment of the nozzle tube 84, the dome wall 46, or both. Holding the mounting base 86 directly during the application of rotational forces to the shaft assembly 110 may not be feasible due to the position of the mounting base 86 inside the case 29 (e.g., insufficient room for tools, inaccessible, etc.). In some examples, the one or more fasteners 98 can be provided through the case 29 to fasten to a mounting arm of the plurality of mounting arms 80. For example, the first mounting arm 92 can, in some examples, include an arm through hole 120 and one of the fasteners 98 can extend through the case 29 and into or through the arm through hole 120. With such a configuration, the mounting arms 80 can be rigidly fixed to the case 29 and abut, or be spaced from and positioned adjacent to, the mounting base 86 to restrict movement of the mounting base 86.

One or more mounting arms of the plurality of mounting arms 80 can include a stepped profile defined by an arm body 122 having a step portion 124. In some examples, as illustrated herein, the step portion 124 can include the arm through hole 120, where the fastener 98 extends through the case 29 and into the arm through hole 120 to couple the combustor 30 with the case 29. The step portion 124 can, for example, extend radially outward from the arm body 122, relative to the combustor centerline 82.

Figure 6:
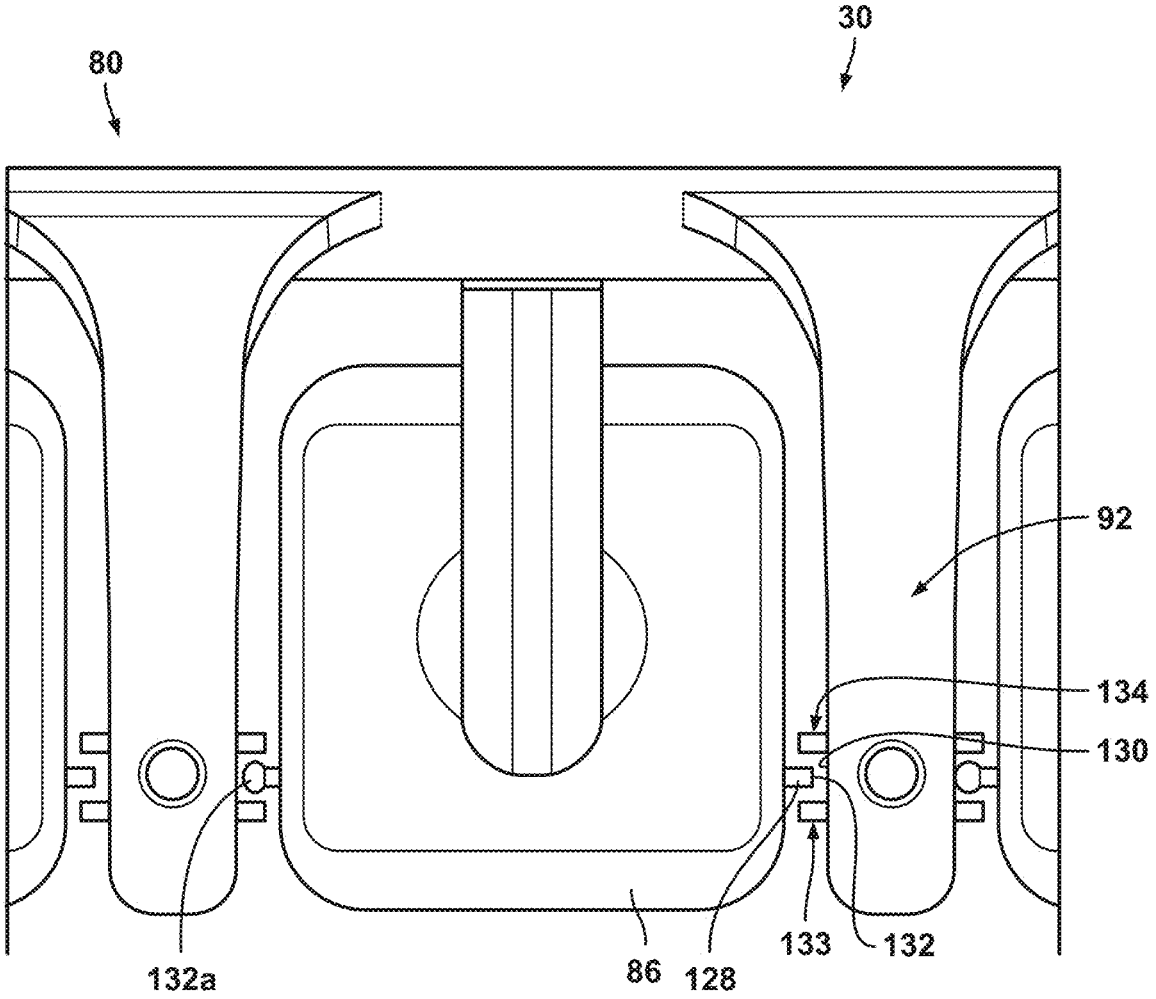
FIG. 6 is a schematic view of a mounting base received by a plurality of mounting arms, looking radially outward from a combustor centerline, in accordance with various aspects described herein.

FIG. 6 depicts an exemplary embodiment of the combustor 30 with the mounting base 86 engaged with the plurality of mounting arms 80 in an exemplary configuration. A protrusion 128 can extend from one of the mounting base 86 or the first mounting arm 92. The protrusion 128 can be received in a recess 130 of the other of the mounting base 86 or the first mounting arm 92. As a non-limiting example, the protrusion 128 extends from the mounting base 86 and is received in the recess 130 formed by the first mounting arm 92. As illustrated, the first mounting arm 92 can include a pair of projections 133, 134 that extend circumferentially, relative to the combustor centerline 82 (FIG. 5), to at least partially define the recess 130 therebetween. The protrusion 128 extends from the mounting base 86 to a distal end 132 received between the pair of projections 133, 134 forming the recess 130. The protrusion 128 can be rectangular or cylindrical. In some examples, the distal end 132 can include a bulbous tip 132*a*. The protrusion 128 is illustrated with the mounting base 86 and the first mounting arm 92 in the first engaged configuration. For example, the protrusion 128 is received in the recess 130 and spaced from the first mounting arm 92, including the pair of projections 133, 134, but is moveable to contact either of the pair of projections 133, 134 to restrict movement (e.g., axial movement, circumferential movement, rotational movement, etc.) of the mounting base 86, such as with the mounting base 86 and the first mounting arm 92 in the second engaged configuration. In this way, the protrusion 128 received in the recess 130 can support the mounting base 86 and restrict movement (e.g., rearward movement) of the mounting base 86 as the combustor 30 is inserted forward into the case 29 during assembly.

Figure 7A:
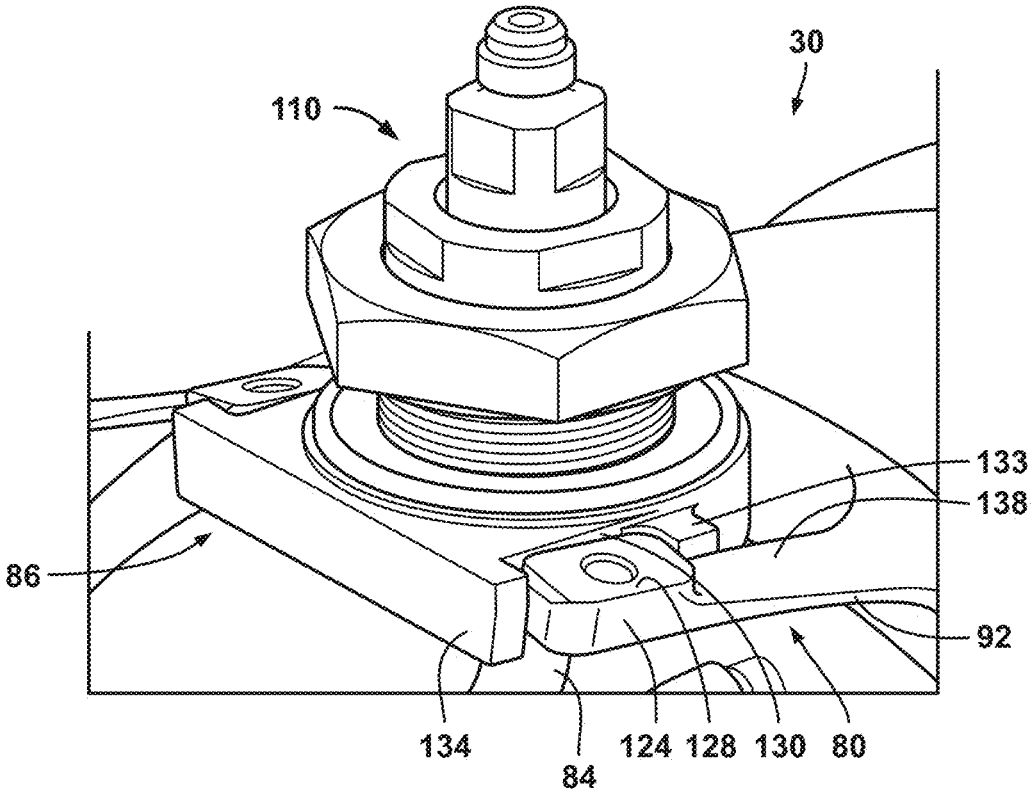
FIG. 7A is a perspective view of a mounting base engaged with a plurality of mounting arms in accordance with various aspects described herein.
Figure 7B:
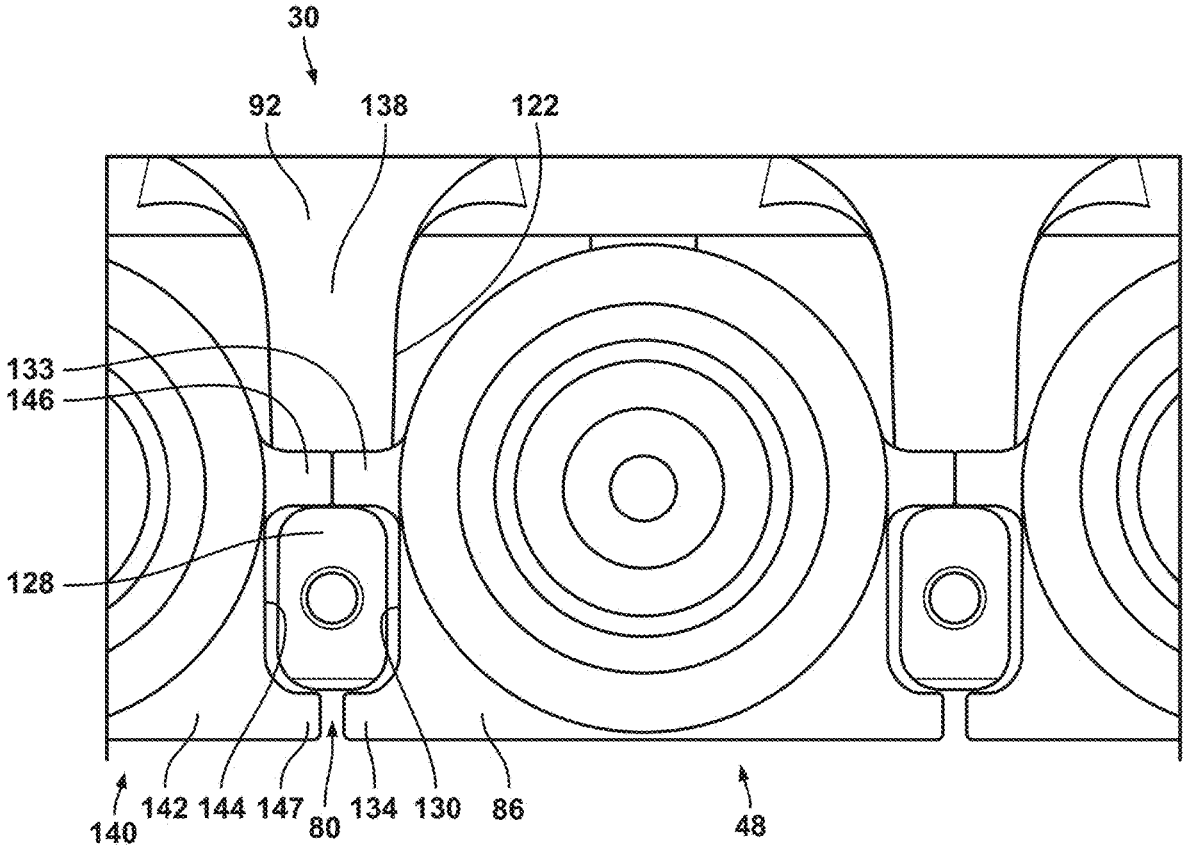
FIG. 7B is a schematic view of the mounting base of FIG. 7A, looking toward a combustor centerline, in accordance with various aspects described herein.

Referring to FIG. 7A and FIG. 7B, an exemplary embodiment of the combustor 30 is illustrated that includes similar aspects to the embodiment of FIG. 6, and like numbers will be used for like parts. In the example of FIGS. 7A and 7B, the mounting base 86 is engaged with a pair of mounting arms of the plurality of mounting arms 80, but the mounting base 86 defines the recess 130, and the protrusion 128 extends from the first mounting arm 92. For example, the protrusion 128 can extend from an outer radial surface 138 of the first mounting arm 92, relative to the combustor centerline 82 (FIG. 5), can at least partially define the step portion 124, and can be received at least partially in the recess 130.

The pair of projections 133, 134 can extend from the mounting base 86 in a circumferential direction, relative to the combustor centerline 82 (FIGS. 3-4), and can at least partially define the recess 130 of the mounting base 86. For example, the protrusion 128 can be engaged with the pair of projections 133, 134 of the mounting base 86 such that the protrusion 128 is at least partially received between the pair of projections 133, 134 but not in contact with the mounting base 86, while being positioned to restrict movement of the mounting base 86, such as during assembly. In FIG. 7A, the mounting base 86 is illustrated as engaged with the shaft assembly 110.

Referring to FIG. 7B, the fuel nozzle assembly 48 can be a first fuel nozzle assembly, the mounting base 86 can be a first mounting base, the pair of projections 133, 134 can be a first pair of first nozzle projections, and the recess 130 can be a first recess. The combustor 30 can further comprise a second fuel nozzle assembly 140 including a second mounting base 142 that can define a second recess 144. In such a configuration, the protrusion 128 can be partially received in both the recess 130 and the second recess 144.

The mounting base 86 can be in contact with the second mounting base 142. For example, the second mounting base 142 can include a first pair of second nozzle projections 146, 147 that extend toward the mounting base 86 to at least partially define the second recess 144. The projection 133 and the second nozzle projection 146 can be in contact with each other, the projection 134 and the second nozzle projection 147 can be in contact with each other, or a combination thereof. The mounting base 86 and the second mounting base 142 can be in contact with the first mounting arm 92, such as with the protrusion 128. The first mounting arm 92 can include the step portion 124 (FIG. 7A), which can be at least partially defined by the protrusion 128 extending from a portion of the arm body 122 having a lesser thickness than the protrusion 128. A shape of the protrusion 128 can correspond to a shape of the recess 130 formed between the pair of projections 133, 134, a shape of the recess 144 formed between the pair of projections 146, 147, or a combination thereof. In some examples, as illustrated, at least one projection of the pair of projections 133, 134, at least one projection of the pair of projections 146, 147, or both, is located forward of a forward end of the first mounting arm 92.

Figure 7C:
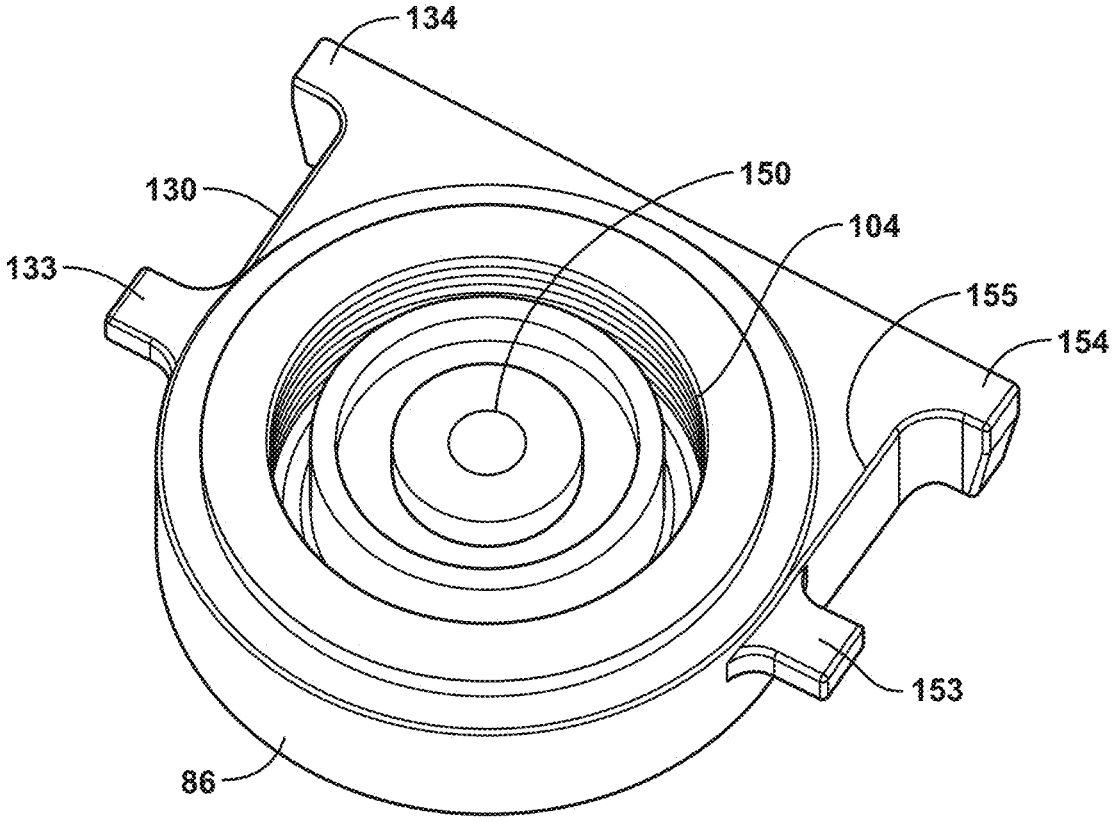
FIG. 7C is a perspective view of the mounting base of FIGS. 7A-7B, further illustrating a pair of projections in accordance with various aspects described herein.

Turning to FIG. 7C, the mounting base 86 is illustrated with the channel 104, the pair of projections 133, 134 extending outward to at least partially define the recess 130, a pair of projections 153, 154 extending in the circumferential direction opposite the pair of projections 133, 134 to at least partially define a recess 155, and a fuel port 150 through which fuel F (FIG. 5) can flow, such as from the shaft assembly 110 (FIG. 5) to the nozzle tube 84 (FIG. 7A).

Figure 8A:
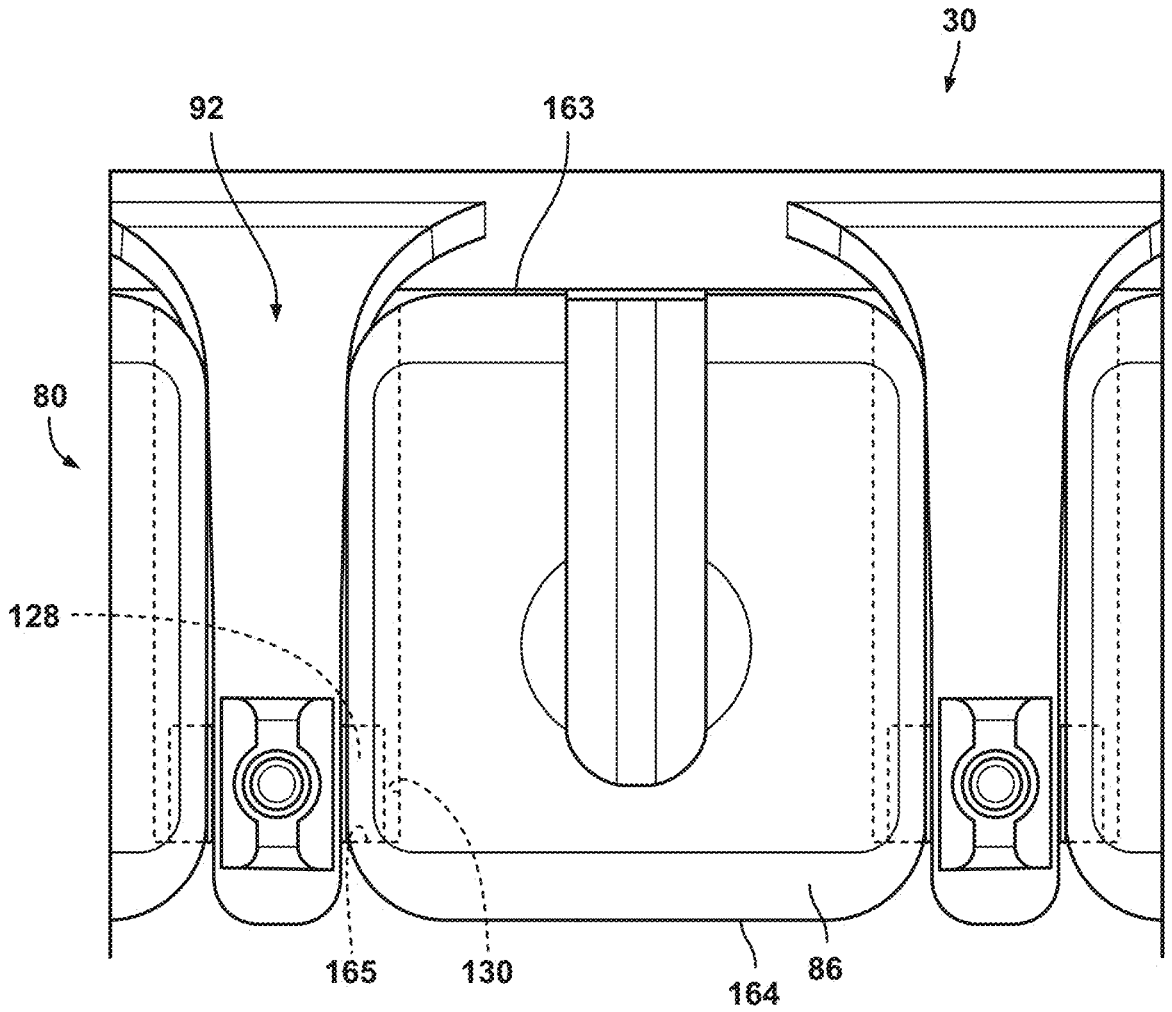
FIG. 8A is a schematic view of a mounting base engaged with a plurality of mounting arms, looking radially outward from a combustor centerline, in accordance with various aspects described herein.
Figure 8B:
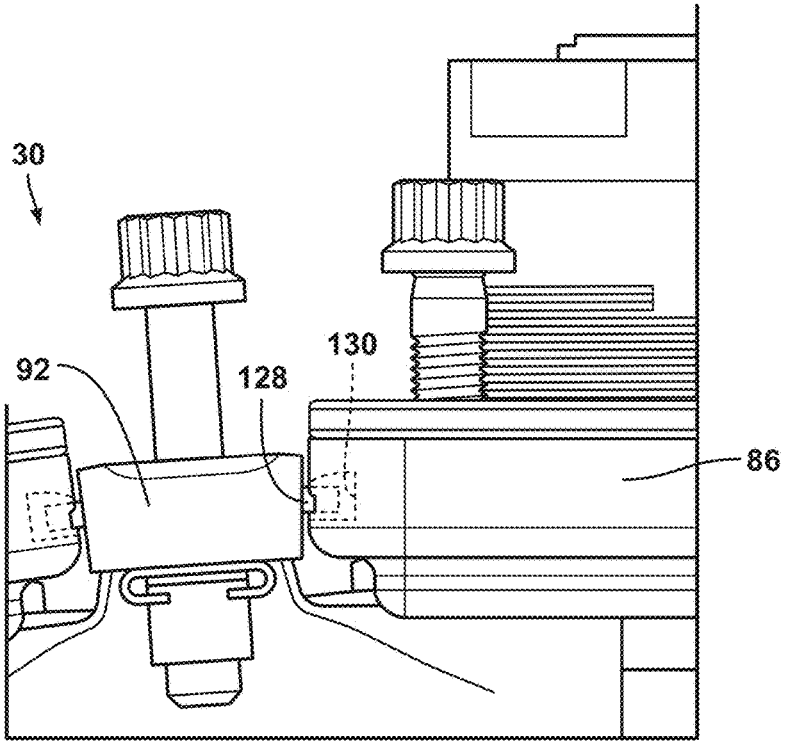
FIG. 8B is a schematic view of the mounting base engaged with a mounting arm in the plurality of mounting arms of FIG. 8A, from forward looking aft, further illustrating a protrusion engaged with a recess in accordance with various aspects described herein.
Figure 8C:
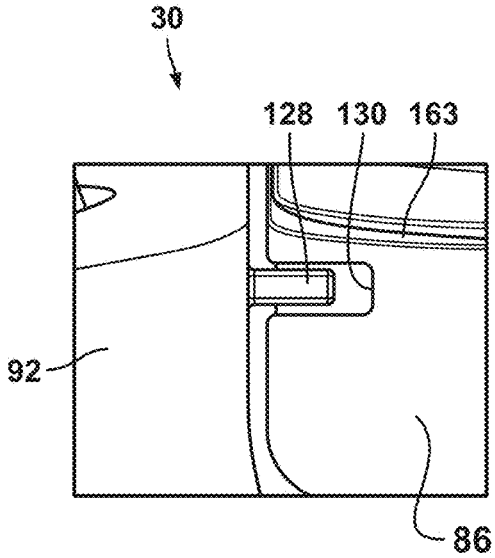
FIG. 8C is a schematic view of the mounting base engaged with a mounting arm in the plurality of mounting arms of FIG. 8A and FIG. 8B, from aft looking forward, further illustrating the protrusion engaged with the recess in accordance with various aspects described herein.

FIGS. 8A-8C illustrate an exemplary embodiment of the combustor 30 that includes similar aspects to the embodiment of FIG. 6, and like numbers will be used for like parts. In the exemplary embodiment of FIGS. 8A-8C, the recess 130 can be formed in a surface of the mounting base 86 or the first mounting arm 92 that faces the other of the mounting base 86 or the first mounting arm 92. In the illustrated example, the mounting base 86 includes the recess 130 and the protrusion 128 extends from the first mounting arm 92 and is received in the recess 130. In some examples, as illustrated in FIG. 8A, the recess 130 can extend from an aft end 163 of the mounting base 86 toward a forward end 164 of the mounting base 86 such that a wall 165 is provided at or proximate the forward end 164. For example, the protrusion 128, received in the recess 130, can engage (e.g., contacts) the wall 165 to limit aft movement of the mounting base 86.

Figure 8D:
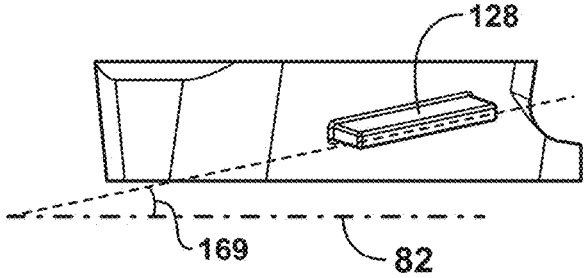
FIG. 8D is a perspective view of portions of the mounting arm in the plurality of mounting arms of FIG. 8A and FIG. 8B, further illustrating the protrusion in accordance with various aspects described herein.

Turning to FIG. 8D, the protrusion 128 can, for example, be angled (e.g., relative to the combustor centerline 82) to increase friction between the protrusion 128 and the mounting base 86 (FIGS. 8A-8C). An angle 169 defined between the protrusion 128 and the combustor centerline 82 can, for example, be greater than 0 degrees and less than or equal to 45 degrees. With some examples, the protrusion 128 includes a planar configuration with an axial extent that is greater than its radial extent (e.g., its thickness), its circumferential extent, or both. For example, the axial extent of the protrusion 128 can be at least twice a long as the circumferential extent, at least five times as long as the radial extent, or both.

Figure 9A:
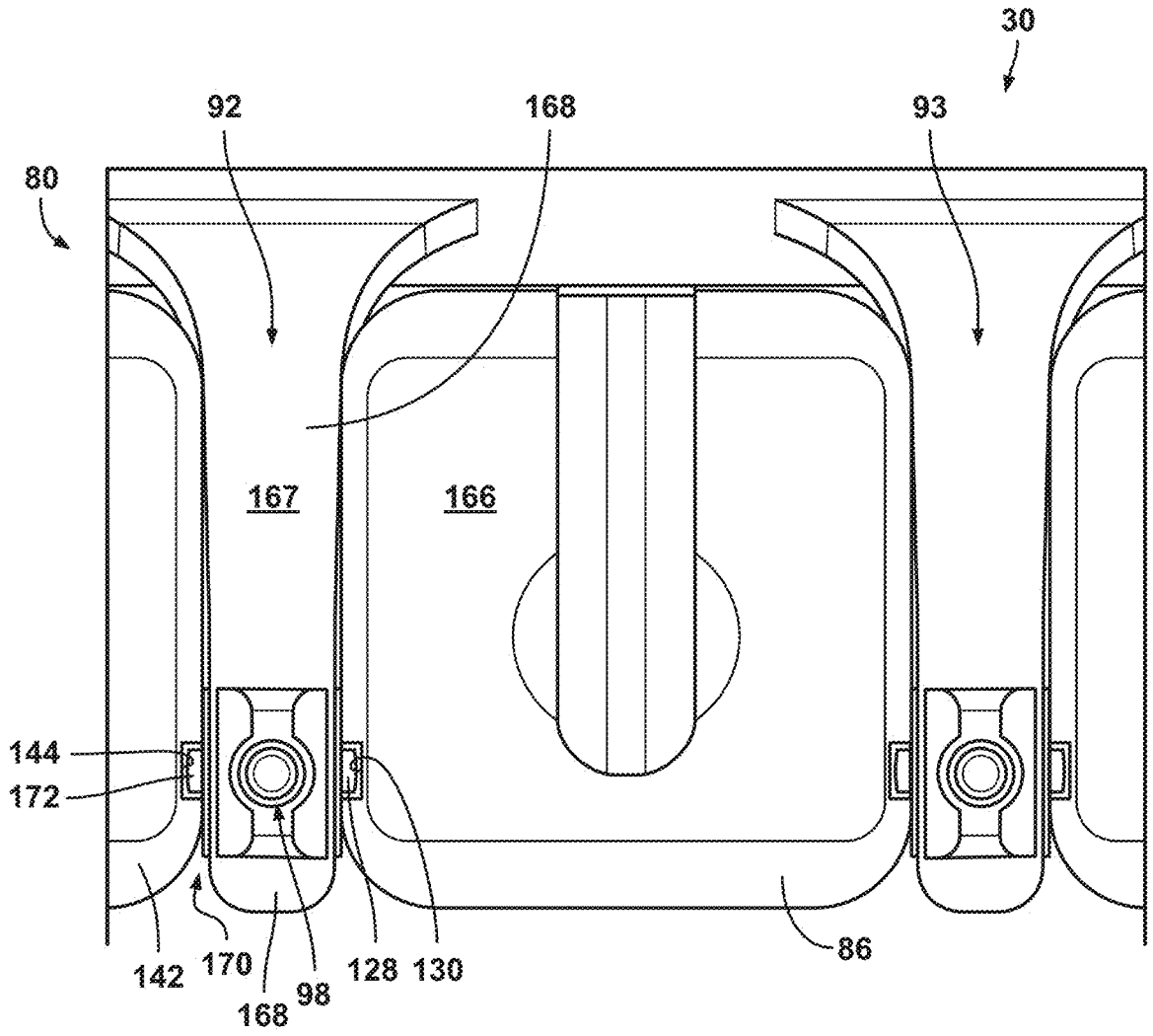
FIG. 9A is a perspective view of a mounting base engaged with a plurality of mounting arms having a bracket, looking radially outward from a combustor centerline, in accordance with various aspects described herein.
Figure 9B:
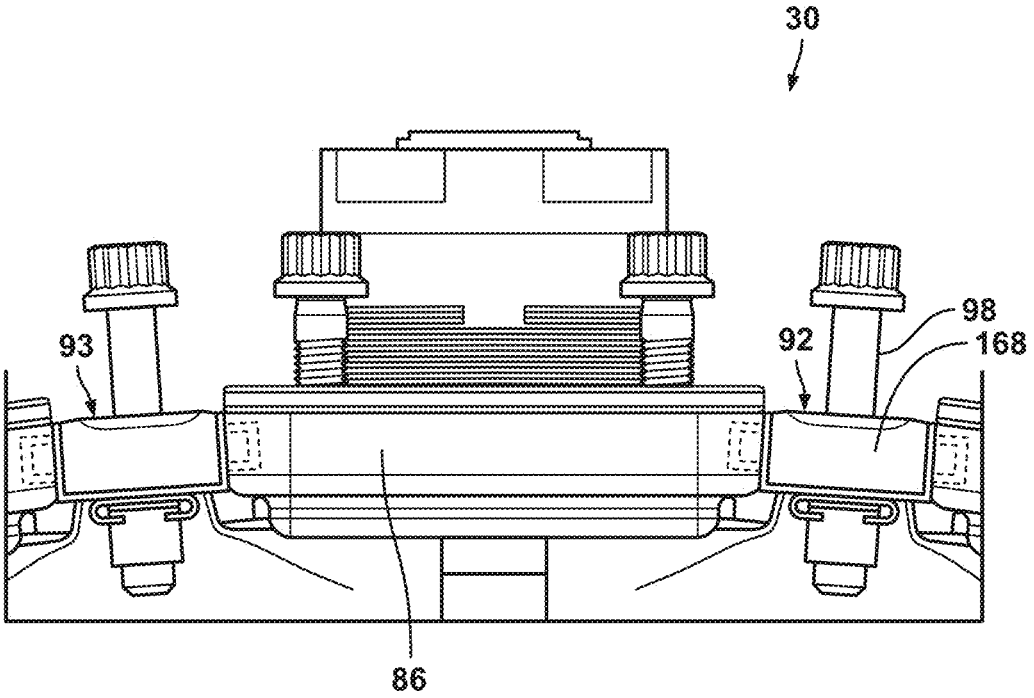
FIG. 9B is a schematic view of the mounting base engaged with the plurality of mounting arms of FIG. 9A, from forward looking aft, further illustrating the bracket in accordance with various aspects described herein.
Figure 9C:
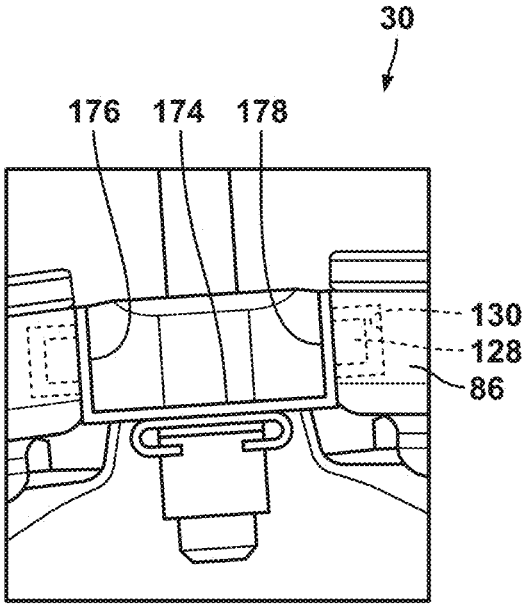
FIG. 9C is a schematic view of the mounting base engaged with a bracket of a mounting arm in the plurality of mounting arms of FIGS. 9A-9B, from forward looking aft, in accordance with various aspects described herein.

Referring to FIGS. 9A-9C, an exemplary embodiment of the combustor 30 is illustrated that includes similar aspects to the embodiment of FIG. 8, and like numbers will be used for like parts. In the example of FIG. 9A and FIG. 9B, the mounting base 86 engaged with the plurality of mounting arms 80, including the first mounting arm 92 and the second mounting arm 93, but with the protrusion 128 provided by a bracket 170 of the first mounting arm 92. In some examples, the recess 130 can be formed in an inner radial surface 166 of the mounting base 86 or an inner radial surface 167 of the first mounting arm 92 relative to the combustor centerline 82. In the illustrated example, the recess 130 is formed in the inner radial surface 166 of the mounting base 86. The first mounting arm 92 can include an arm body 168 and the bracket 170, and the mounting base 86 can engage with the bracket 170. The bracket 170 can be coupled with the inner radial surface 167 of the first mounting arm 92. One of the mounting base 86 or the bracket 170 can include the protrusion 128. The protrusion 128 can be received in the recess 130 formed in the other of the mounting base 86 and the bracket 170. As illustrated, the protrusion 128 can be a first protrusion of the bracket 170, and the bracket 170 can include a second protrusion 172. In such a configuration, the protrusion 128 is received in the recess 130 of the mounting base 86 and the second protrusion 172 is received in the second recess 144 of the second mounting base 142. One of the fasteners 98 can extend through the case 29, the arm body 168, and the bracket 170.

Figure 9D:
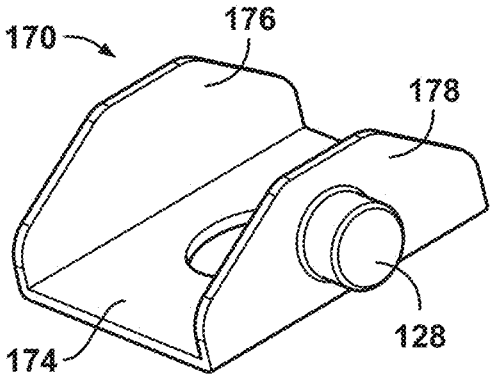
FIG. 9D is a perspective view of the bracket of FIGS. 9A-9B, in accordance with various aspects described herein.

Turning to FIG. 9C and FIG. 9D, the bracket 170 is illustrated as having a middle portion 174 and sidewalls 176, 178 in a C-shaped profile that opens radially outward. As illustrated in FIG. 9C, the protrusion 128 extends from one of the sidewalls 176, 178, and the protrusion 128 is received in the recess 130 formed in the mounting base 86. While the protrusion 128 is illustrated in FIG. 9D as having a round cross-section, other cross-sectional shapes are contemplated, including but not limited to, other arcuate shapes (e.g., curved, circular, oval), polygonal shapes (e.g., a rectangle, hexagon, among others), or a combination thereof.

Figure 10A:
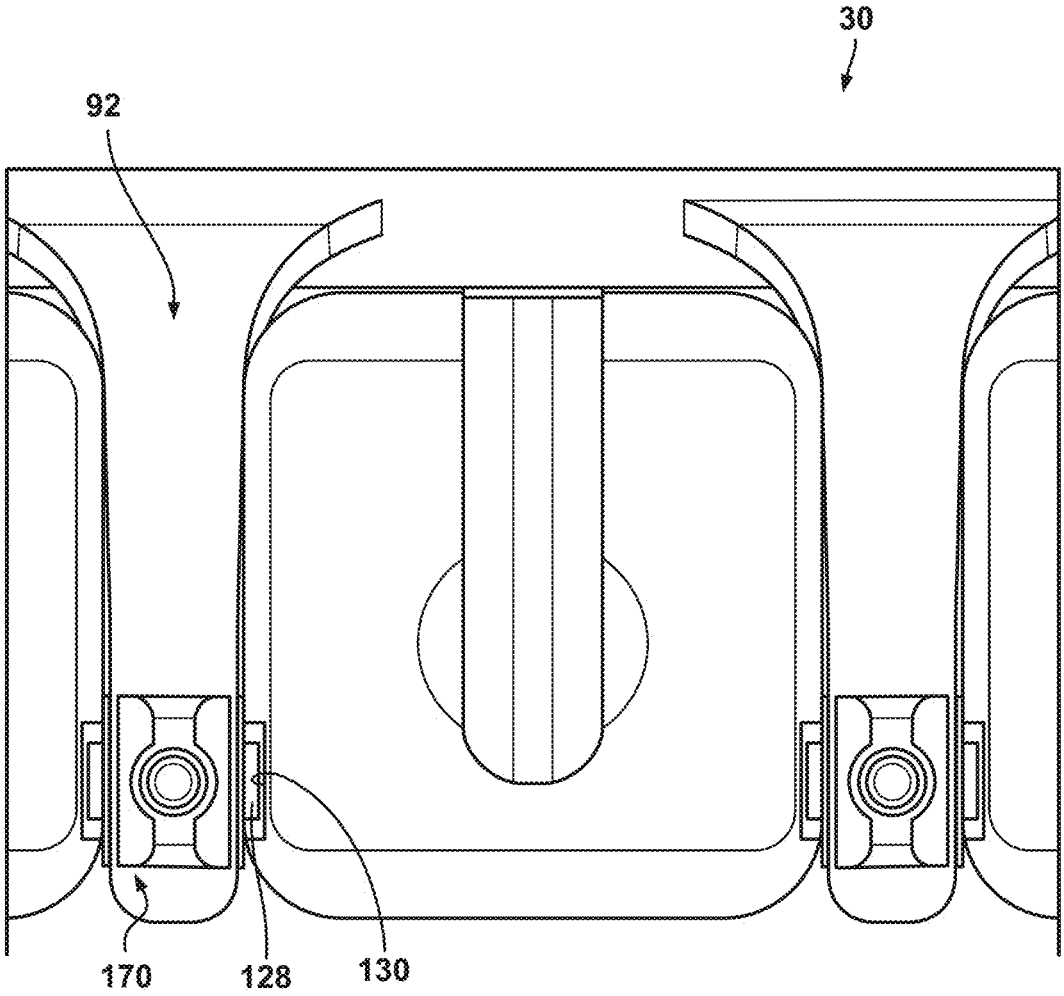
FIG. 10A is a schematic view of a mounting base engaged with a plurality of mounting arms having a bracket, looking radially outward from a combustor centerline, in accordance with various aspects described herein.
Figure 10B:
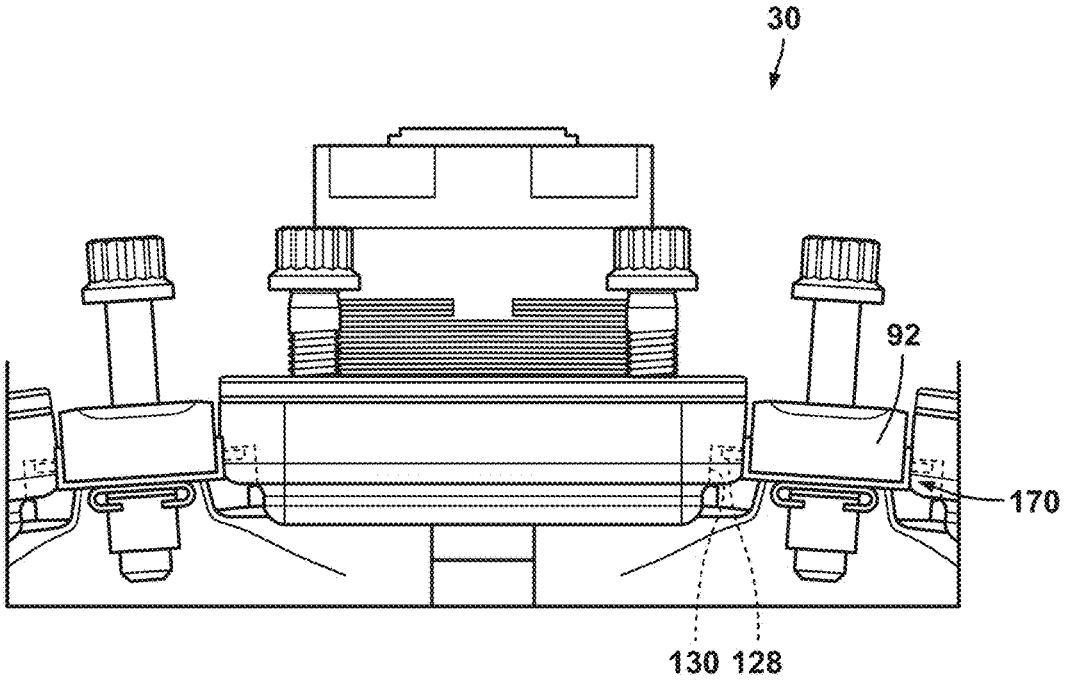
FIG. 10B is a schematic view of the mounting base engaged with the plurality of mounting arms of FIG. 10A, from forward looking aft, further illustrating the bracket in accordance with various aspects described herein.
Figure 10C:
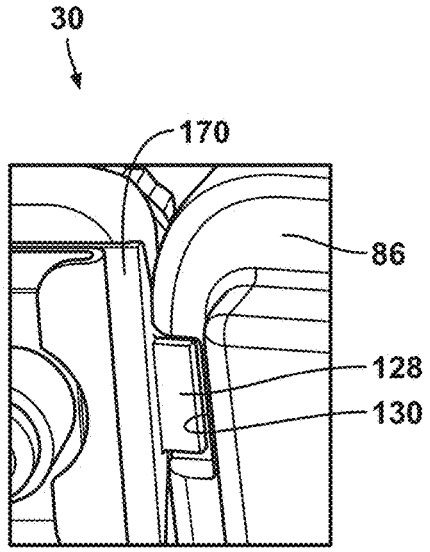
FIG. 10C is a schematic view of the mounting base engaged with a bracket of a mounting arm in the plurality of mounting arms of FIG. 10A and FIG. 10B, looking radially outward from a combustor centerline, in accordance with various aspects described herein.
Figure 10D:
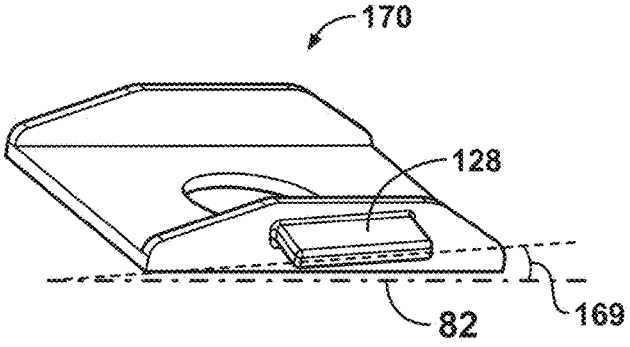
FIG. 10D is a perspective view of the bracket of FIG. 10A and FIG. 10B in accordance with various aspects described herein.

Referring to FIGS. 10A-10C, an exemplary embodiment of the combustor 30 is illustrated that includes similar aspects to the embodiment of FIGS. 9A-9D, and like numbers will be used for like parts. As illustrated in FIG. 10A-10D, the protrusion 128 can be provided by the bracket 170 of the first mounting arm 92 and have a flat geometric profile, as opposed to the rounded geometric profile shown in FIGS. 9A-9D. FIGS. 10A-10C illustrate the recess 130 formed in the mounting base 86 with the protrusion 128 received therein. The recess 130 is illustrated as open radially inward and circumferentially toward the mounting base 86, as opposed to the recess 130 of the embodiment of FIGS. 9A-9C that is illustrated open circumferentially toward the mounting base 86 and not open radially inward. A shape of the recess 130 can correspond to the shape of the protrusion 128. For example, the recess 130 can have a shorter radial dimension and a longer axial dimension, relative to the combustor centerline 82 (FIGS. 3-4), compared to the configuration of the recess 130 illustrated in FIG. 9A. Similar to FIG. 8D, the bracket 170 is shown in FIG. 10D, for example, with the protrusion 128 angled relative to the combustor centerline 82 at the angle 169, which can be greater than or equal to 0 and less than or equal to 45 degrees.

Figure 11A:
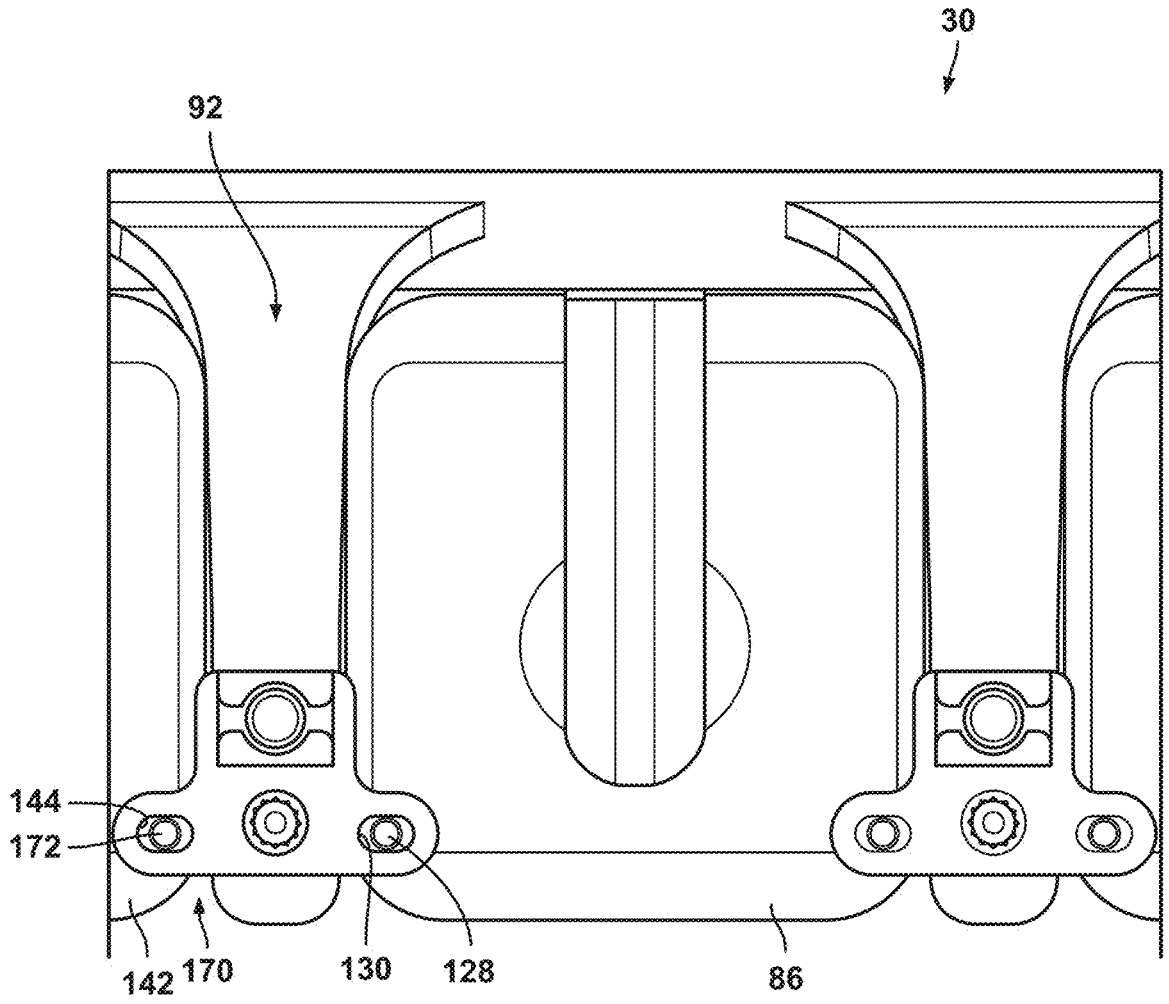
FIG. 11A is a schematic view of a mounting base engaged with a plurality of mounting arms having a bracket, looking outward from a combustor centerline, in accordance with various aspects described herein.
Figure 11B:
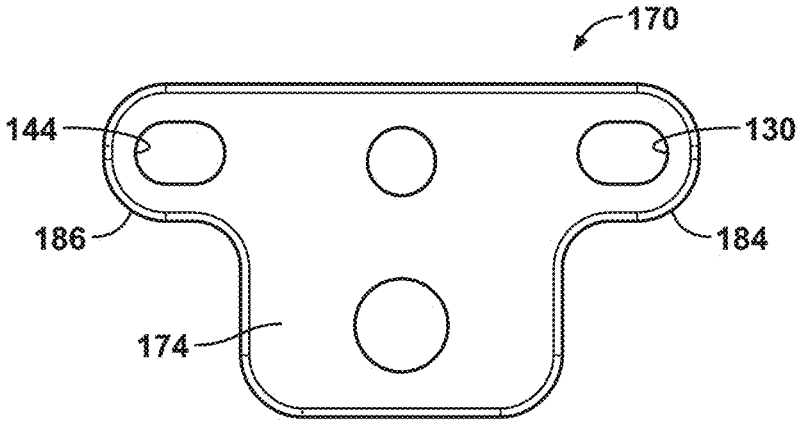
FIG. 11B is a schematic view of portions of a mounting base engaged with a plurality of mounting arms of FIG. 11A, from forward looking aft, further illustrating the bracket in accordance with various aspects described herein.
Figure 11C:
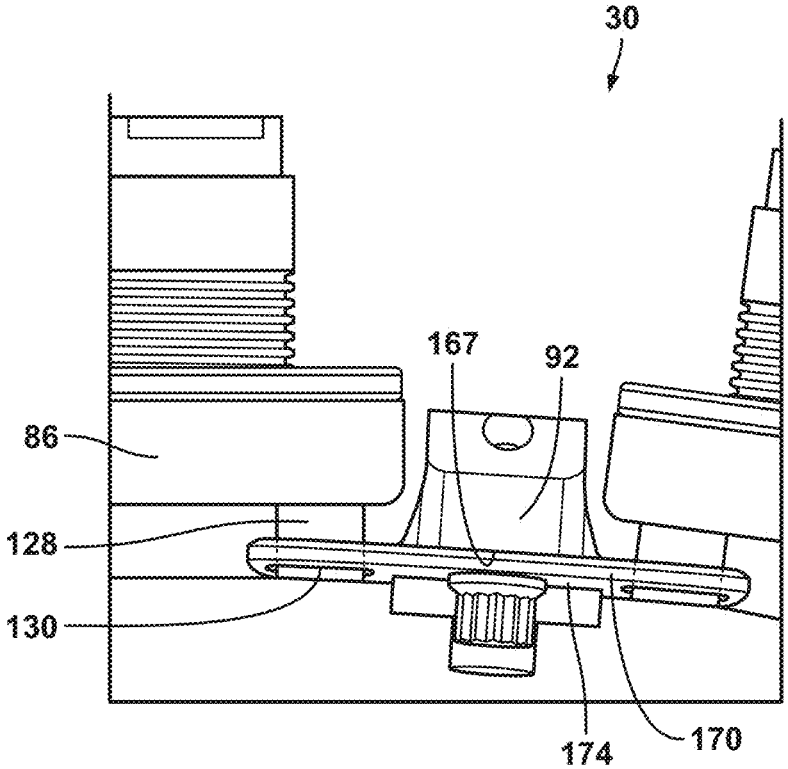
FIG. 11C is a planar view of the bracket of FIG. 11A and FIG. 11B in accordance with various aspects described herein.

Referring to FIGS. 11A-11C, an exemplary embodiment of the combustor 30 and portions thereof are illustrated that includes similar aspects to the embodiment of FIGS. 9A-9D, and like numbers will be used for like parts. As illustrated in FIG. 11A, the recess 130 and the second recess 144 can be formed in the bracket 170 of the first mounting arm 92 and the protrusion 128 can extend (e.g., radially inward) from the mounting base 86, as opposed to the configuration of FIGS. 9A-9D in which the mounting base 86 provides the recess 130 and the bracket 170 provides the protrusion 128.

The second protrusion 172 can extend (e.g., radially inward) from the second mounting base 142. The protrusion 128 can be disposed at least partially in the recess 130, and the second protrusion 172 can be disposed at least partially in the second recess 144.

FIG. 11B illustrates the bracket 170 as having the middle portion 174 with first and second tab portions 184, 186 extending in opposite axial directions from the middle portion 174 in a T-shaped configuration. The recess 130 can be formed in the first tab portion 184 and the second recess 144 can be formed in the second tab portion 186.

As illustrated in FIG. 11C, the protrusion 128 of the mounting base 86 is disposed at least partially in the recess 130 and can restrict relative movement between the mounting base 86 and the first mounting arm 92. The middle portion 174 can be coupled with an inner radial surface 167 of the first mounting arm 92.

Figure 12A:
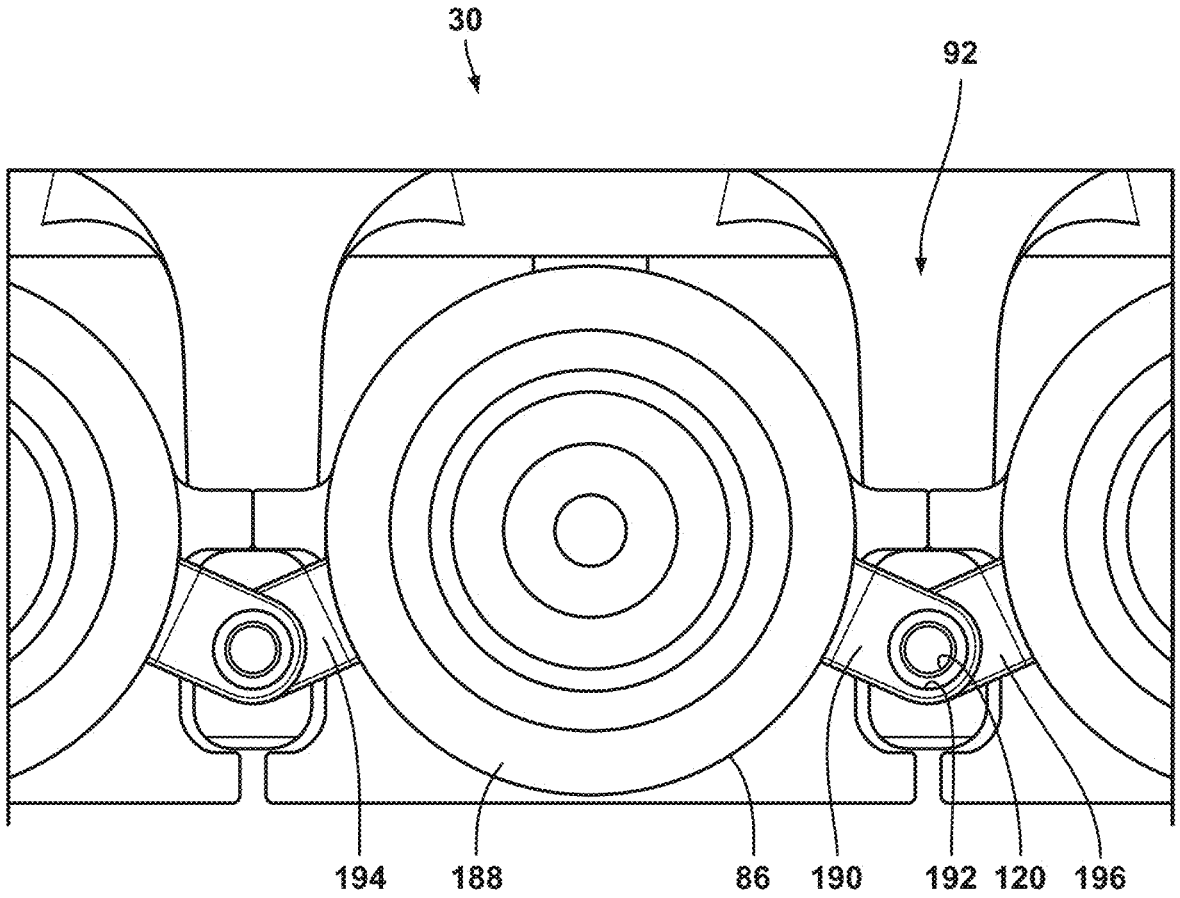
FIG. 12A is a schematic view of a mounting base having a flange engaged with a plurality of mounting arms, looking toward a combustor centerline, in accordance with various aspects described herein.
Figure 12B:
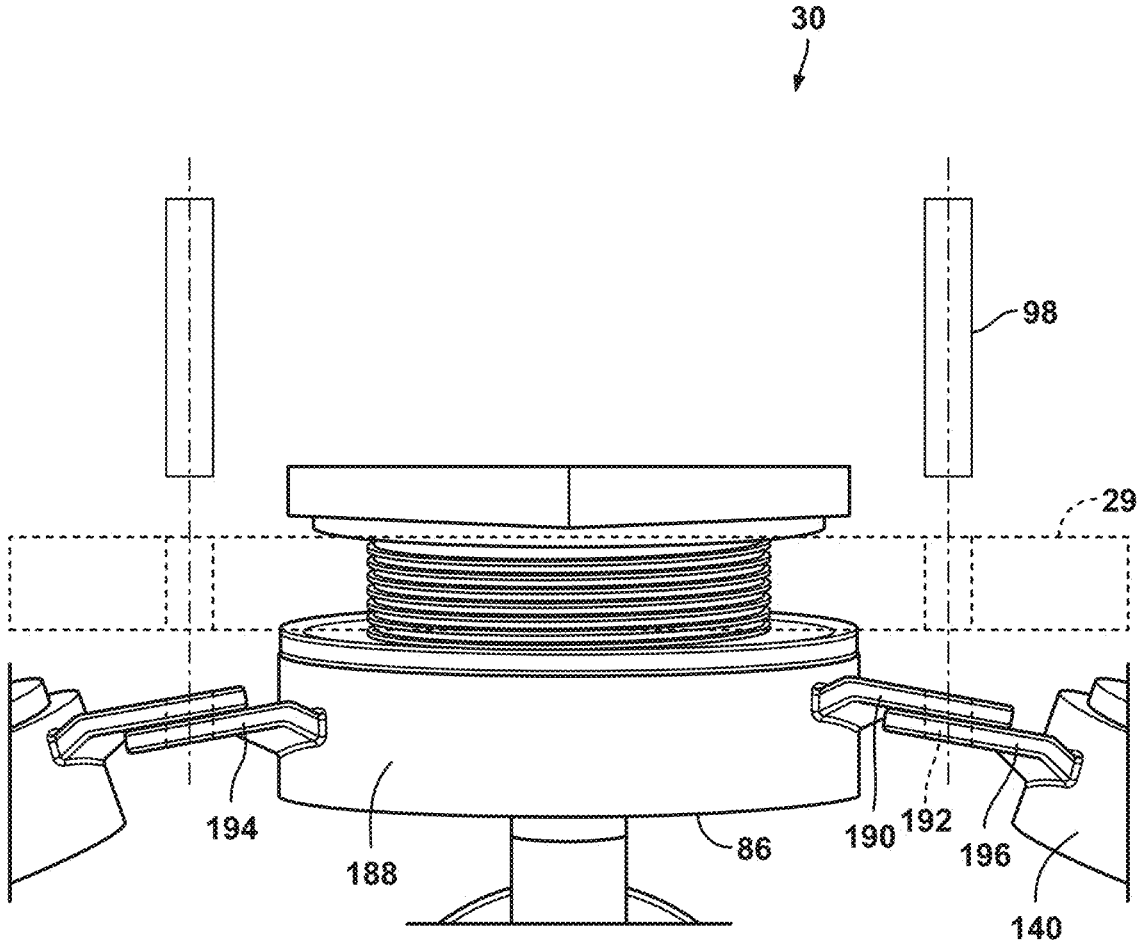
FIG. 12B is a schematic view of the mounting base of FIG. 12A, from forward looking aft, further illustrating the flange, in accordance with various aspects described herein.

FIG. 12A and FIG. 12B depict an exemplary embodiment of the combustor 30 that includes similar aspects to prior embodiments, and like numbers will be used for like parts. As illustrated in FIGS. 12A and 12B, the mounting base 86 can include a mounting body 188 and a flange 190 extending from the mounting body 188. The flange 190 can define a flange through hole 192 such that one of the fasteners 98 (FIG. 12B) can extend through the case 29 (FIG. 12B) and into the flange through hole 192. In some examples, as illustrated in FIG. 12A, the flange through hole 192 can align with the arm through hole 120 formed in the first mounting arm 92. In such a configuration, one of the fasteners 98 can extend through the case 29 (FIG. 12B), through the flange through hole 192, and at least partially through the arm through hole 120 (FIG. 12A).

The flange 190 can be a first flange, and the mounting base 86 can further include a second flange 194 extending from the mounting body 188. The second fuel nozzle assembly 140 can include a third flange 196 that is in contact with the flange 190. While the flange 190 is illustrated as overlaying the third flange 196, the flange 190 can, in some examples, be disposed between the first mounting arm 92 and the third flange 196 (e.g., the third flange 196 overlays the first flange 190). In such a configuration, one of the fasteners 98 can extend through the case 29 (FIG. 12B), through the first flange 190, through the third flange 196, and at least partially through the first mounting arm 92 (FIG. 12A).

Figure 13:
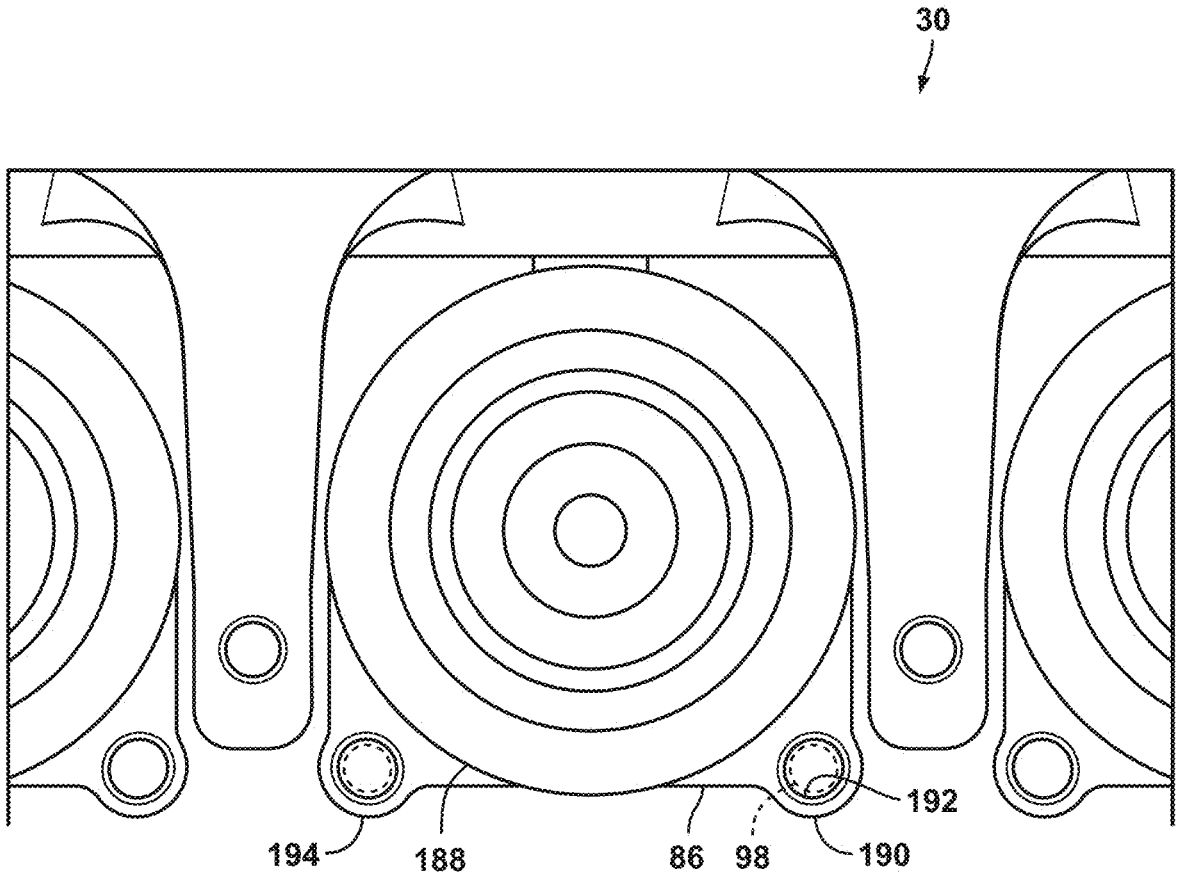
FIG. 13 is a schematic view of a mounting base having a flange engaged with a plurality of mounting arms, looking toward a combustor centerline, in accordance with various aspects described herein.

FIG. 13 depicts an exemplary embodiment of the combustor 30 that includes similar aspects to prior embodiments, and like numbers will be used for like parts. As illustrated in FIG. 13, the mounting base 86 can include the flange 190, which can extend forward from the mounting body 188. The mounting base 86 can also include the second flange 194 extending forward from the mounting body 188. Similar to FIG. 12A, the flange 190 defines the flange through hole 192 such that the fastener 98 can extend through the case 29 (FIG. 3) and into the flange through hole 192 to fasten the mounting base 86 to the case 29 (FIG. 3).

Figure 14:
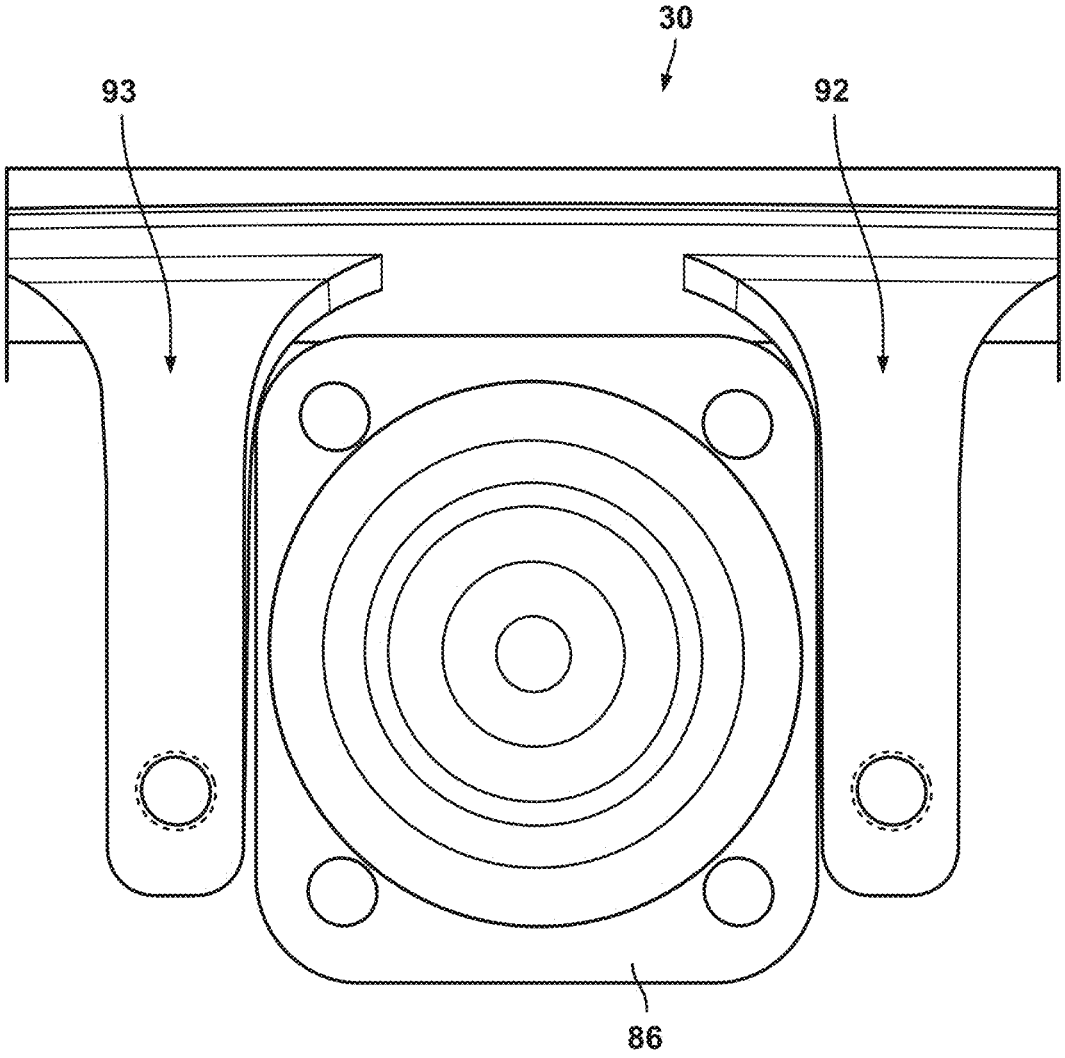
FIG. 14 is a schematic view of a mounting base engaged with a plurality of mounting arms, looking toward a combustor centerline, in accordance with various aspects described herein.

FIG. 14 depicts an exemplary embodiment of the combustor 30 that includes similar aspects to prior embodiments, and like numbers will be used for like parts. As illustrated in FIG. 14, the mounting base 86 can abut or be positioned adjacent to the first mounting arm 92, the second mounting arm 93, or both, to restrict movement of the mounting base 86, such as during rotation of the shaft assembly 110 (FIG. 4).

Figure 15:
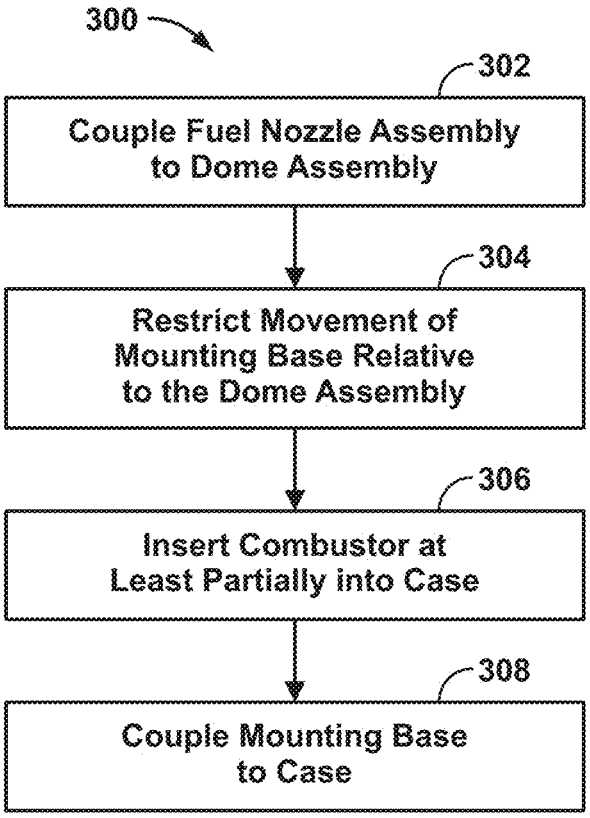
FIG. 15 is a flow diagram illustrating a method of assembling a gas turbine engine in accordance with various aspects described herein.

Referring to FIG. 15, a method 300 of assembling a turbine engine is illustrated, which can be utilized with the turbine engine 10 and components thereof illustrated in FIGS. 1-14. The method 300 can include coupling the fuel nozzle assembly 48, 140 with the dome assembly 44 (block 302), restricting movement of a mounting base 86, 142 of the fuel nozzle assembly 48, 140 relative to the dome assembly 44 between a first mounting arm 92 and a second mounting arm 93 (block 304), inserting the combustor 30 at least partially into the case 29 (block 306), and coupling the mounting base 86, 142 of the fuel nozzle assembly 48, 140 with the case 29 (block 308).

The restricting the movement of the mounting base 86, 142 (block 302) can include rigidly fixing the mounting base 86, 142 to an inner surface 60 of the case 29; receiving the protrusion 128 in the recess 130; and inserting a fastener 98 through the case 29, the mounting base 86, 142, and the first mounting arm 92.

Coupling the mounting base 86, 142 with the case 29 (block 308) can include inserting the fastener 98 through the case 29 and the flange through hole 192, coupling the bracket 170 to the inner radial surface 167 of the first mounting arm 92 relative to the combustor centerline 82, inserting the protrusion 128 into the recess 130 of the mounting base 86, and inserting the second protrusion 172 into the second recess 144 of the second mounting base 142 of the second fuel nozzle assembly 140.

Optionally, the method 300 can include coupling the bracket 170 to the arm body 122, such as with configurations in which the first mounting arm 92 includes an arm body 122 and a bracket 170 and prior to restricting the movement of the mounting base 86, 142.

Many other possible aspects and configurations in addition to those shown in the above figures are contemplated by the present disclosure. The aspects disclosed herein can provide more uniform clamping force between the fuel nozzle assembly 48 and the case 29, fix relative positions of the fuel nozzle assembly 48, the case 29, and the dome wall 46, and reduce or restrict movement of the mounting base 86 with respect to the combustor 30 as the combustor 30 is inserted forward into the case 29. The aspects disclosed herein can also improve ease of assembly and reduce damage and wear to the fuel nozzle assembly, the case, or a combination thereof (e.g., chafing of mounting base surfaces about the casing aperture).

The various configurations disclosed herein are not mutually exclusive. For example, the combustor 30 can include combinations of the configurations of the fuel nozzle assemblies 48 and first and second mounting arms 92, 93 illustrated in FIGS. 4-14. In an example, the combustor 30 includes at least nine different configurations of the fuel nozzle assemblies 48, including at least one of each of the configuration shown in FIG. 6, the configuration shown in FIGS. 7A-7C, the configuration shown in FIGS. 8A-8D, the configuration shown in FIGS. 9A-9D, the configuration shown in FIGS. 10A-10D, the configuration shown in FIGS. 11A-11C, the configuration shown in FIGS. 12A and 12B, the configuration shown in FIG. 13, and the configuration shown in FIG. 14.

Further aspects are provided by the subject matter of the following clauses:

A gas turbine engine comprising: a compressor section, a combustion section, and a turbine section in a serial flow arrangement, the combustion section comprising: a case; and a combustor disposed at least partially in the case and comprising: a dome assembly; a liner coupled with the dome assembly and at least partially defining a combustion chamber; a plurality of mounting arms extending forward from the dome assembly; and a fuel nozzle assembly coupled with the dome assembly and including a mounting base, the mounting base coupled with the case and engaged with a first mounting arm of the plurality of mounting arms and a second mounting arm of the plurality of mounting arms.

The gas turbine engine of any proceeding clause, wherein the mounting base is rigidly fixed to an inner surface of the case.

The gas turbine engine of any proceeding clause, wherein a fastener extends through the case and is fastened to the first mounting arm.

The gas turbine engine of any proceeding clause, wherein the fastener extends into and fastens to a through hole in the first mounting arm.

The gas turbine engine of any proceeding clause, wherein the first mounting arm restricts rotation of the mounting base.

The gas turbine engine of any proceeding clause, wherein, when torque is applied to the mounting base, the first mounting arm abuts the mounting base and restricts rotation of the mounting base.

The gas turbine engine of any proceeding clause, wherein a protrusion extends from one of the mounting base or the first mounting arm, and the protrusion is received in a recess of the other of the mounting base or the first mounting arm.

The gas turbine engine of any proceeding clause, wherein the protrusion extends from the mounting base.

The gas turbine engine of any proceeding clause, wherein the first mounting arm includes a pair of projections that at least partially define the recess.

The gas turbine engine of any proceeding clause, wherein the mounting base and the first mounting arm include a first engaged configuration in which the protrusion is spaced from the first mounting arm, and a second engaged configuration in which the protrusion is in contact with one projection of the pair of projections to restrict movement of the mounting base relative to the dome assembly.

The gas turbine engine of any proceeding clause, wherein at least one projection of the pair of projections is located forward of the first mounting arm.

The gas turbine engine of any proceeding clause, wherein a distal end of the protrusion includes a bulbous tip.

The gas turbine engine of any proceeding clause, wherein the mounting base includes the recess; and wherein the protrusion extends from an outer radial surface of the first mounting arm relative to a centerline of the combustor and is received in the recess of the mounting base.

The gas turbine engine of any proceeding clause, wherein the fuel nozzle assembly is a first fuel nozzle assembly, the mounting base is a first mounting base, and the recess is a first recess; wherein the combustor further comprises a second fuel nozzle assembly including a second mounting base; wherein the second mounting base defines a second recess; wherein the protrusion is partially received in both the first recess and the second recess.

The gas turbine engine of any proceeding clause, wherein the first mounting base is in contact with the second mounting base.

The gas turbine engine of any proceeding clause, wherein the first mounting base and the second mounting base are in contact with the first mounting arm.

The gas turbine engine of any proceeding clause, wherein the second mounting base includes a first pair of second nozzle projections that extends toward the first mounting base to at least partially define the second recess.

The gas turbine engine of any proceeding clause, wherein a first pair of first nozzle projections extend from the first mounting base, and the first pair of second nozzle projections is in contact with a projection of the first pair of first nozzle projections.

The gas turbine engine of any proceeding clause, wherein the case defines an aperture, and the fuel nozzle assembly further comprises a shaft assembly abutting an outer surface of the case about the aperture, wherein the shaft assembly extends through the aperture and is threadedly engaged with the mounting base.

The gas turbine engine of any proceeding clause, wherein the fuel nozzle assembly further comprises a seal between the mounting base and the inner surface of the case.

The gas turbine engine of any proceeding clause, wherein the seal is a first seal, and the fuel nozzle assembly further includes a second seal between the shaft assembly and the mounting base.

The gas turbine engine of any proceeding clause, wherein the first mounting arm includes a stepped profile defined by a reduced thickness portion adjacent to a step portion.

The gas turbine engine of any proceeding clause, wherein the step portion includes a through hole, and a fastener extends through the case and into the through hole to couple the combustor with the case.

The gas turbine engine of any proceeding clause, wherein the one of the mounting base or the first mounting arm that includes the recess includes a pair of projections at least partially defining the recess, and wherein the protrusion is received between the pair of projections.

The gas turbine engine of any proceeding clause, wherein a pair of projections extend from the mounting base in a circumferential direction and at least partially define the recess of the mounting base; and wherein the protrusion is received between the pair of projections.

The gas turbine engine of any proceeding clause, wherein the first mounting base and the second mounting base are in contact with the protrusion.

The gas turbine engine of any proceeding clause, wherein the first mounting arm includes a stepped profile defined by a reduced thickness portion adjacent to the protrusion.

The gas turbine engine of any proceeding clause, wherein a shape of the protrusion corresponds to a shape of the recess formed between the pair of projections.

The gas turbine engine of any proceeding clause, wherein the recess is formed in a surface of the mounting base or the first mounting arm that faces the other of the mounting base or the first mounting arm.

The gas turbine engine of any proceeding clause, wherein a protrusion extends from the first mounting arm, and the protrusion is received in a recess of the mounting base.

The gas turbine engine of any proceeding clause, wherein the protrusion is angled relative to a centerline of the combustor to increase friction between the protrusion and the mounting base.

The gas turbine engine of any proceeding clause, wherein the recess extends to an aft surface of the mounting base.

The gas turbine engine of any proceeding clause, wherein the recess is formed in an inner radial surface of the mounting base or the first mounting arm relative to a centerline of the combustor.

The gas turbine engine of any proceeding clause, wherein the first mounting arm includes an arm body and a bracket, and the mounting base engages with the bracket.

The gas turbine engine of any proceeding clause, wherein the bracket is coupled with an inner radial surface of the first mounting arm relative to a centerline of the combustor.

The gas turbine engine of any proceeding clause, wherein one of the mounting base or the bracket includes a protrusion, and the protrusion is received in a recess formed in the other of the mounting base and the bracket.

The gas turbine engine of any proceeding clause, wherein a fastener extends through the case, the arm body, and the bracket.

The gas turbine engine of any proceeding clause, wherein the bracket includes a first protrusion and a second protrusion; wherein the fuel nozzle assembly is a first fuel nozzle assembly, the mounting base is a first mounting base, and the first mounting base includes a first recess; wherein the combustor further comprises a second fuel nozzle assembly including a second mounting base; wherein the second mounting base includes a second recess; and wherein the first protrusion is received in the first recess of the first mounting base and the second protrusion is received in the second recess of the second mounting base.

The gas turbine engine of any proceeding clause, wherein the bracket has a middle portion and sidewalls in a C-shaped profile that opens radially outward.

The gas turbine engine of any proceeding clause, wherein a protrusion extends from one of the sidewalls, and the protrusion is received in a recess formed in the mounting base.

The gas turbine engine of any proceeding clause, wherein the protrusion has a round cross-section.

The gas turbine engine of any proceeding clause, wherein the protrusion has a rectangular cross-section.

The gas turbine engine of any proceeding clause, wherein the bracket includes a first recess and a second recess, the fuel nozzle assembly is a first fuel nozzle assembly, and the mounting base is a first mounting base and includes a first protrusion; wherein the combustor further comprises a second fuel nozzle assembly including a second mounting base that includes a second protrusion; wherein the first protrusion is disposed at least partially in the first recess, and the second protrusion is disposed at least partially in the second recess.

The gas turbine engine of any proceeding clause, wherein the bracket has a middle portion, a first tab portion, and a second tab portion; and wherein the first tab portion and the second tab portion extend in opposite axial directions from the middle portion in a T-shaped configuration.

The gas turbine engine of any proceeding clause, wherein the mounting base includes an inner radial surface and a protrusion extending from the inner radial surface of the mounting base; and wherein the first tab portion defines a recess; and wherein the protrusion is disposed at least partially in the recess to restrict relative movement between the mounting base and the mounting arm.

The gas turbine engine of any proceeding clause, wherein the middle portion is coupled with an inner radial surface of the first mounting arm relative to a centerline of the combustor.

The gas turbine engine of any proceeding clause, wherein the mounting base includes a mounting body and a flange extending from the mounting body; wherein the flange defines a flange through hole; and wherein a fastener extends through the case and into the flange through hole.

The gas turbine engine of any proceeding clause, wherein the flange overlays the first mounting arm.

The gas turbine engine of any proceeding clause, wherein the flange through hole aligns with an arm through hole formed in the first mounting arm, and wherein the fuel nozzle assembly includes a fastener extending through the case, through the flange through hole, and at least partially through the arm through hole.

The gas turbine engine of any proceeding clause, wherein the flange is a first flange, and the mounting base further includes a second flange extending from the mounting body; wherein the fuel nozzle assembly is a first fuel nozzle assembly; and wherein the combustor further comprises a second fuel nozzle assembly including a third flange that is in contact with the first flange.

The gas turbine engine of any proceeding clause, wherein the first flange overlays the third flange.

The gas turbine engine of any proceeding clause, wherein the first flange is disposed between and in contact with the first mounting arm and the third flange.

The gas turbine engine of any proceeding clause, wherein the fuel nozzle assembly includes a fastener extending through the case, through the first flange, through the third flange, and at least partially through the first mounting arm.

The gas turbine engine of any proceeding clause, wherein the mounting base includes a mounting body and a flange, wherein the flange extends forward from the mounting body.

The gas turbine engine of any proceeding clause, wherein a flange includes a through hole and a fastener extends through the case and into the through hole to fasten the mounting base to the case.

A method of assembling a turbine engine including a case and a combustor with a dome assembly, a combustor liner, a plurality of mounting arms extending forward from the dome assembly, and a fuel nozzle assembly, the method comprising: coupling the fuel nozzle assembly with the dome assembly; restricting movement of a mounting base of the fuel nozzle assembly relative to the dome assembly between a first mounting arm and a second mounting arm; inserting the combustor at least partially into the case; and coupling the mounting base with the case.

The method of any proceeding clause, wherein a protrusion extends from one of the mounting base or the first mounting arm and a recess is formed in the other of the mounting base or the first mounting arm; wherein the restricting the movement of the mounting base includes receiving the protrusion in the recess.

The method of any proceeding clause, wherein the restricting the movement of the mounting base includes rigidly fixing the mounting base to an inner surface of the case.

The method of any proceeding clause, wherein the restricting the movement of the mounting base includes inserting a fastener through the case, the mounting base, and the first mounting arm.

The method of any proceeding clause, wherein the mounting arm includes a through hole; and wherein coupling the mounting base with the case includes inserting a fastener through the case and the through hole.

The method of any proceeding clause, wherein the first mounting arm includes an arm body and a bracket; wherein the method includes, prior to restricting the movement of the mounting base, coupling the bracket to the arm body.

The method of any proceeding clause, wherein coupling the bracket to the arm body includes coupling the bracket to an inner radial surface of the first mounting arm relative to a centerline of the combustor.

The method of any proceeding clause, wherein the bracket includes a first protrusion and a second protrusion, the mounting base is a first mounting base; and wherein coupling the bracket to the arm body includes inserting the first protrusion into a first recess of the first mounting base and inserting the second protrusion into a second recess of a second mounting base of a second fuel nozzle.

The method of any proceeding clause, wherein the bracket includes a first recess and a second recess; wherein the fuel nozzle is a first fuel nozzle and includes a first protrusion; wherein the combustor includes a second fuel nozzle including a second protrusion; and wherein coupling the bracket to the arm body includes inserting the first protrusion into the first recess and inserting the second protrusion into the second recess.

The method of any proceeding clause, wherein the first mounting arm includes a stepped profile defined by a reduced thickness portion adjacent to a protrusion; and the restricting the movement of the mounting base includes receiving the protrusion in a recess formed in the mounting base.

What is claimed is:

1. A gas turbine engine comprising:

a compressor section, a combustion section, and a turbine section in a serial flow arrangement, the combustion section comprising:

a case; and a combustor disposed at least partially in the case and comprising:

a dome assembly;

a liner coupled with the dome assembly and at least partially defining a combustion chamber;

a plurality of mounting arms extending forward from the dome assembly; and a fuel nozzle assembly coupled with the dome assembly and including a mounting base, the mounting base coupled with the case and engaged with a first mounting arm of the plurality of mounting arms and a second mounting arm of the plurality of mounting arms.

2. The gas turbine engine of claim 1, wherein the mounting base is rigidly fixed to an inner surface of the case.

3. The gas turbine engine of claim 1, wherein a fastener extends through the case and is fastened to the first mounting arm.

4. The gas turbine engine of claim 1, wherein the first mounting arm restricts rotation of the mounting base.

5. The gas turbine engine of claim 1, wherein a protrusion extends from one of the mounting base or the first mounting arm, and the protrusion is received in a recess of the other of the mounting base or the first mounting arm.

6. The gas turbine engine of claim 5, wherein the protrusion extends from the mounting base.

7. The gas turbine engine of claim 6, wherein the first mounting arm includes a pair of projections that at least partially define the recess.

8. The gas turbine engine of claim 7, wherein the mounting base and the first mounting arm include a first engaged configuration in which the protrusion is spaced from the first mounting arm, and a second engaged configuration in which the protrusion is in contact with one projection of the pair of projections to restrict movement of the mounting base relative to the dome assembly.

9. The gas turbine engine of claim 7, wherein at least one projection of the pair of projections is located forward of the first mounting arm.

10. The gas turbine engine of claim 5, wherein a distal end of the protrusion includes a bulbous tip.

11. The gas turbine engine of claim 5, wherein the mounting base includes the recess; and wherein the protrusion extends from an outer radial surface of the first mounting arm relative to a centerline of the combustor and is received in the recess of the mounting base.

12. The gas turbine engine of claim 11, wherein the fuel nozzle assembly is a first fuel nozzle assembly, the mounting base is a first mounting base, and the recess is a first recess;

wherein the combustor further comprises a second fuel nozzle assembly including a second mounting base;

wherein the second mounting base defines a second recess; and wherein the protrusion is partially received in both the first recess and the second recess.

13. The gas turbine engine of claim 12, wherein the first mounting base is in contact with the second mounting base.

14. The gas turbine engine of claim 12, wherein the first mounting base and the second mounting base are in contact with the first mounting arm.

15. The gas turbine engine of claim 12, wherein the second mounting base includes a first pair of second nozzle projections that extends toward the first mounting base to at least partially define the second recess.

16. The gas turbine engine of claim 15, wherein a first pair of first nozzle projections extend from the first mounting base, and the first pair of second nozzle projections is in contact with the first pair of first nozzle projections.

17. A method of assembling a turbine engine including a case and a combustor with a dome assembly, a combustor liner, a plurality of mounting arms extending forward from the dome assembly, and a fuel nozzle assembly, the method comprising:

coupling the fuel nozzle assembly with the dome assembly;

restricting movement of a mounting base of the fuel nozzle assembly relative to the dome assembly between a first mounting arm and a second mounting arm;

inserting the combustor at least partially into the case; and coupling the mounting base with the case.

18. The method of claim 17, wherein a protrusion extends from one of the mounting base or the first mounting arm and a recess is formed in the other of the mounting base or the first mounting arm; and wherein the restricting the movement of the mounting base includes receiving the protrusion in the recess.

19. The method of claim 17, wherein the restricting the movement of the mounting base includes rigidly fixing the mounting base to an inner surface of the case.

20. The method of claim 17, wherein the restricting the movement of the mounting base includes inserting a fastener through the case, the mounting base, and the first mounting arm.

* * * * *